US009291931B2

(12) United States Patent
Awamura et al.

(10) Patent No.: US 9,291,931 B2
(45) **Date of Patent: *Mar. 22, 2016**

(54) ELECTROSTATIC CHARGE IMAGE DEVELOPING TONER

(71) Applicant: RICOH COMPANY, LTD., Tokyo (JP)

(72) Inventors: Junichi Awamura, Shizuoka (JP); Tsuneyasu Nagatomo, Shizuoka (JP); Satoshi Kojima, Shizuoka (JP); Shingo Sakashita, Shizuoka (JP); Tomoki Murayama, Kanagawa (JP); Masaya Fukuda, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 14/182,446

(22) Filed: Feb. 18, 2014

(65) Prior Publication Data

US 2014/0234767 A1 Aug. 21, 2014

(30) Foreign Application Priority Data

Feb. 21, 2013 (JP) ..... 2013-031754

(51) Int. Cl.
*G03G 9/08* (2006.01)
*G03G 9/097* (2006.01)
*G03G 9/087* (2006.01)

(52) U.S. Cl.
CPC ..... *G03G 9/09725* (2013.01); *G03G 9/0804* (2013.01); *G03G 9/08755* (2013.01); *G03G 9/09716* (2013.01)

(58) Field of Classification Search
CPC ..... G03G 9/09725; G03G 9/09716; G03G 9/09708; G03G 9/08755; G03G 9/08797; G03G 9/08795
USPC ..... 430/108.7, 109.4
See application file for complete search history.

(56) References Cited

U.S. PATENT DOCUMENTS

| | | | | |
|---|---|---|---|---|
| 8,603,718 | B2 | 12/2013 | Suzuki et al. | |
| 8,956,795 | B2 * | 2/2015 | Kojima et al. | 430/108.1 |
| 9,005,864 | B2 * | 4/2015 | Satoh et al. | 430/123.51 |
| 2005/0202332 | A1 * | 9/2005 | Ninomiya et al. | 430/110.3 |
| 2009/0196658 | A1 * | 8/2009 | Sugiura | 399/252 |
| 2010/0203443 | A1 * | 8/2010 | Okita et al. | 430/124.1 |
| 2011/0229811 | A1 * | 9/2011 | Saito et al. | 430/105 |
| 2011/0294058 | A1 | 12/2011 | Shiba et al. | |
| 2012/0082926 | A1 | 4/2012 | Suzuki et al. | |
| 2012/0156601 | A1 * | 6/2012 | Kitajima et al. | 430/105 |
| 2012/0264043 | A1 | 10/2012 | Watanabe et al. | |
| 2012/0288791 | A1 | 11/2012 | Sakashita et al. | |

(Continued)

FOREIGN PATENT DOCUMENTS

| | | |
|---|---|---|
| JP | 11-174731 | 7/1999 |
| JP | 2005-173480 | 6/2005 |

(Continued)

*Primary Examiner* — Hoa V Le
(74) *Attorney, Agent, or Firm* — Oblon, McClelland, Maier & Neustadt, L.L.P.

(57) ABSTRACT

Provided is an electrostatic charge image developing toner, including: toner base particles including a polyester resin as a binder resin; and an external additive on the surface of the toner base particles. The external additive includes silica. The silica is produced by sol-gel method, and is aspherical. The percentage of change in the specific surface area of the toner when it is stored under high-temperature, high-humidity conditions is from 25% to 45%.

8 Claims, 4 Drawing Sheets

(56) References Cited

U.S. PATENT DOCUMENTS

| | | | | |
|---|---|---|---|---|
| 2013/0011779 | A1 | 1/2013 | Yamashita et al. | |
| 2013/0017480 | A1 | 1/2013 | Suzuki et al. | |
| 2013/0130171 | A1 | 5/2013 | Watanabe et al. | |
| 2013/0157183 | A1 | 6/2013 | Santo et al. | |
| 2013/0157184 | A1 | 6/2013 | Sugimoto et al. | |
| 2013/0157185 | A1 | 6/2013 | Sakashita et al. | |
| 2013/0196260 | A1 | 8/2013 | Yoshida et al. | |
| 2013/0196263 | A1 | 8/2013 | Asahina et al. | |
| 2013/0216944 | A1 | 8/2013 | Shiba et al. | |
| 2013/0236826 | A1 | 9/2013 | Makabe et al. | |
| 2013/0243488 | A1* | 9/2013 | Kojima et al. | 399/252 |
| 2013/0244154 | A1 | 9/2013 | Yamamoto et al. | |
| 2013/0244155 | A1* | 9/2013 | Satoh et al. | 430/105 |
| 2013/0244156 | A1* | 9/2013 | Kojima et al. | 430/105 |
| 2013/0252158 | A1 | 9/2013 | Yamada et al. | |

FOREIGN PATENT DOCUMENTS

| | | |
|---|---|---|
| JP | 2006-267950 | 10/2006 |
| JP | 2010-128216 | 6/2010 |
| JP | 2010-243664 | 10/2010 |
| JP | 2013-064819 | 4/2013 |
| WO | WO2013/137366 A1 | 9/2013 |

* cited by examiner

ELECTROSTATIC CHARGE IMAGE DEVELOPING TONER

BACKGROUND OF THE INVENTION

1. Field of the Invention

The present invention relates to a toner used as a developer for developing an electrostatic charge image formed by electrophotography, electrostatic recording, etc., and an image forming apparatus using the toner.

2. Description of the Related Art

In recent years, image forming apparatuses have been required to produce high-quality images, and studies have been made to develop a toner excellent in heat resistant storage stability, transfer property, flowability, filming resistance, charge property, etc.

In order to improve heat resistant storage stability of a toner, there is proposed a toner having a core-shell structure in which a shell layer containing a resin different from a binder resin is formed on the surface of the toner particles (see, e.g., Japanese Patent Application Laid-Open (JP-A) No. 2006-267950). However, the problem of this proposed toner is that a pigment cannot be dispersed throughout the shell layer but is lopsidedly deposited on the surface, which degrades the transfer property and flowability of the toner to degrade the image property.

In order to improve transfer property and flowability of a toner, there are proposed toners in which an external additive containing inorganic particles is added (see, e.g., JP-A Nos. 2005-173480 and 2010-128216). These proposals teach to impart a spacer effect to the surface of the toner particles and suppress adhesion between toner particles and occurrence of aggregates of toner particles while the toner is conveyed to thereby improve the transfer property and flowability of the toner and reduce fault images due to degradation of the toner. However, the problem of these proposals is that the toner includes the inorganic particles in an excessive amount, and the inorganic particles tend to be detached. The detached inorganic particles accelerate wear of the cleaning blade or cause filming to thereby degrade the charge property and produce fault images.

In order to improve filming resistance and charge property of a toner, there are proposed toners in which silica having a relatively broad particle size distribution is added as an external additive (see, e.g., JP-A Nos. 11-174731 and 2010-243664). These proposals explain that use of an external additive having a relatively broad particle size distribution allows the toner to have a broad range of charge properties according to the particle size distribution thereof. Silica is greater than alumina in the ability to electrically charge the toner. Silica is not limited to silica derived by sol-gel method (sol-gel silica), and use of dry silica is encouraged because dry silica can impart a broad range of charge properties to the toner according to the particle size distribution of the toner. However, the problem of these proposed toners is that their heat resistant storage stability is poor because they are toners using only dry silica, and that their charge property is significantly degraded under high-temperature, high-humidity conditions.

Therefore, there is a demand for a toner that can secure at the same time, heat resistant storage stability, transfer property, flowability, and filming property, and charge stability even under high-temperature, high-humidity conditions, and has excellent low temperature fixability in terms of energy saving.

SUMMARY OF THE INVENTION

In view of the problems of the conventional art described above, the present invention aims to provide a toner that can secure at the same time, heat resistant storage stability, transfer property, flowability, and filming property, and charge stability even under high-temperature, high-humidity conditions, has excellent low temperature fixability in terms of energy saving, and produces a high-quality image.

Means for solving the problem is as follows.

An electrostatic charge image developing toner of the present invention is a toner, including:

toner base particles that include a polyester resin as a binder resin; and an external additive on the surface of the toner base particles, wherein the external additive contains silica, wherein the silica is produced by sol-gel method and has an aspherical shape, and wherein a percentage of change in the specific surface area of the toner when the toner is stored under high-temperature, high-humidity conditions is from 25% to 45%.

The present invention can provide a toner that can solve the problems of the conventional art described above, can secure at the same time, heat resistant storage stability, transfer property, flowability, and filming property, and charge stability even under high-temperature, high-humidity conditions, has excellent low temperature fixability in terms of energy saving, and produces a high-image quality.

DETAILED DESCRIPTION OF THE INVENTION (Toner)

Figure 1:
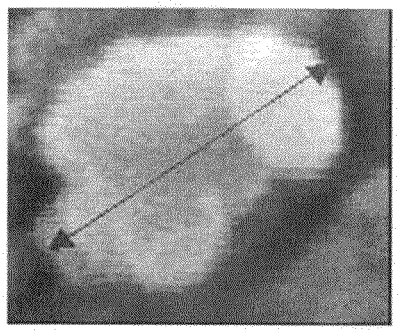
FIG. 1 is a diagram showing a maximum length of a secondary particle aggregate measured in the measurement of a degree of coalescence.

A toner of the present invention includes: toner base particles containing a polyester resin as a binder resin; and an external additive on the surface of the toner base particles.

The external additive contains silica.

The silica is produced by sol-gel method.

The silica is aspherical.

The percentage of change in the specific surface area of the toner when the toner is stored under high-temperature, high-humidity conditions is from 25% to 45%.

The toner of the present invention preferably uses as a binder resin, a polyester resin, which is advantageous for low temperature fixability and has a high affinity with paper. However, although having a favorable affinity with paper, a polyester resin is susceptible to humidity because the polarity thereof is high. Therefore, the charge stability of the polyester resin is susceptible to the environment. Use of silica that is aspherical and derived by sol-gel method as an external additive in order to suppress the susceptibility makes it possible to suppress humidity-induced changes in the nature of the polyester resin and suppress the external additive from being buried in the surface of the base, and to suppress changes in the specific surface area of the toner under high-temperature, high-humidity conditions.

The percentage of change in the specific surface area of the toner under high-temperature, high-humidity conditions is a percentage of change in the specific surface area of the toner between after the toner is stored at a temperature of 40° C. at a relative humidity of 70% for 240 hours and before the toner is stored under these conditions, and is expressed by

[(BET specific surface area of toner before storage−BET specific surface area of toner after storage under high-temperature, high-humidity conditions)/BET specific surface area of toner before storage]×100(%).

The percentage of change in the specific surface area is preferably from 25% to 45%. When the percentage of change is less than 25%, charge stability with respect to the environment is good, but affinity between the resin and paper is poor to degrade the low temperature fixability. When the percentage of change is greater than 45%, change in the nature of the polyester resin due to humidity is great to cause a significant degradation of charge property, which is unfavorable. Therefore, the percentage of change is preferably from 25% to 45%, and more preferably from 30% to 40%.

It is possible to suppress occurrence of fault images by suppressing the external additive from being buried and impart a suitable flowability to the toner.

Fault images include see-throughness of the paper color or unevenness of density because of incapability to uniformly print an image when the image has a large image area. Fault images are produced because the toner aggregates in the image forming apparatus when it is transferred, and the sheet has undulations, to thereby make it impossible for the toner to be transferred precisely to the sheet.

When silica having a relatively small particle diameter is added, flowability can be imparted to the toner. However, on the other hand, the silica is likely to be buried due to stress in the image forming apparatus. Therefore, in order to have stress resistance, the silica preferably has a particle diameter that is large to some degree.

In order for the silica to have stress resistance and charge stability with respect to the environment, the secondary particle diameter of the silica is preferably from 80 nm to 250 nm, and more preferably from 120 nm to 160 nm. When the secondary particle diameter is less than 80 nm, the silica is susceptible to external stress and likely to be buried in the toner. On the other hand, when the secondary particle diameter is greater than 250 nm, the silica may be largely detached from the toner particles. The detached silica may adhere to the photoconductor and solidify on the photoconductor to get the photoconductor filmed or to damage the photoconductor to inhibit the toner from being transferred, which may lead to fault images.

Hence, by being given an irregular shape, the silica will have a greater number of contacts at which it contacts the toner. This enables an external stress, i.e., a force to get the silica buried in the toner, to be distributed better than when the silica has a spherical shape, and enables the silica to be suppressed from being buried. Further, even when the silica is detached onto the photoconductor, it can be scraped off by a cleaning blade more easily than when the silica has a spherical shape and will not remain on the photoconductor. Therefore, occurrence of fault images and filming due to the silica detached onto the photoconductor, and degradation of charge property due to humidity can be suppressed.

The silica having an irregular shape is preferably produced by sol-gel method. The reason is that silica derived by sol-gel method has a sharp particle size distribution, whereas silica derived by dry method tends to have a broad particle size distribution due to the very dry method. Along with this, the dry silica particles will coalesce (hereinafter, coalesced particles will be referred to as secondary particles) to have an even larger particle size distribution to result in non-uniform secondary particles including excessively small particles and excessively large particles. Furthermore, silica derived by sol-gel method has minute pores that are absent in dry silica, and is therefore considered to adsorb gas and moisture in the atmosphere and can reduce influence of humidity to the polyester resin and improve the storage stability and charge stability.

The degree of coalescence of the silica is preferably from 2.0 to 4.0, and more preferably from 2.5 to 3.0. When the degree of coalescence is less than 2.0, the number of contacts with the surface of the toner base particle is substantially the same as when the silica has a spherical shape, and the silica is likely to be buried in the toner base particles. When the degree of coalescence is greater than 4.0, primary particles are too small to obtain secondary particle having a suitable particle diameter, which makes it difficult to control the production of the silica. Furthermore, the silica is more likely to detach from the surface of the toner to cause filming, etc.

For the reasons described above, it is important that sol-gel silica to be added to the toner have an irregular shape and a relatively large particle diameter.

Silica that is obtained by secondarily aggregating primary particles of crystalline silica, molten silica, or both thereof by chemically bonding them using a treating agent is referred to as coalesced silica.

Coalesced silica used in the present invention is prepared by, for example, chemically bonding primary particles of crystalline silica, molten silica, or both thereof using a treating agent. Preferable examples of the treating agent include: silane-based treating agents such as alkoxy silanes, silane-based coupling agents, chlorosilanes, and silazane; and epoxy-based treating agents such as liquid-state epoxy resin. When primary particles of silica are treated using the silane-based treating agent such as the alkoxy silanes and the silane-based coupling agents, a silanol group bonded with the primary particles of the silica and an alkoxy group bonded with the silane-based treating agent react with each other and produce a new Si—O—Si bond by dealcoholization.

That is, the primary particles of the silica secondarily aggregate by chemical bonding via the silane-based treating agent as expressed by the following formula.

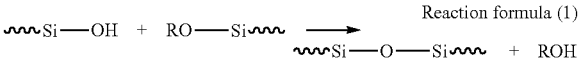

Reaction formula (1)

When the primary particles of the silica are treated using the chlorosilanes, a chloro group of the chlorosilanes and a silanol group bonded with the primary particles of the silica together produce a new Si—O—Si bond through a dehydrochlorination reaction, to allow the primary particles of the silica to secondarily aggregate. Alternatively, when the system is coexistent with water, the chlorosilane is firstly hydrolyzed in the water to produce a silanol group, and this silanol group and a silanol group bonded with the primary particles of the silica produce new Si—O—Si bonds respectively by dehydration reaction, to thereby allow the primary particles of the silica to secondarily aggregate.

When the primary particles of the silica are treated with the silazanes, a silanol group bonded with the primary particles of the silica and an amino group undergo deammoniation to thereby produce a new Si—O—Si bond, to allow the primary particles of the silica to secondarily aggregate.

When the primary particles of the silica are treated with the epoxy-based treating agent, a silanol group bonded with the primary particles of the silica adds to an oxygen atom of an epoxy group of the epoxy-based treating agent or to a carbon atom bonded with the epoxy group and produces a new Si—O—C bond.

That is, the primary particles of the silica secondarily aggregate by chemical bonding via the epoxy-based treating agent as expressed by the following formula.

Reaction Formula (2)

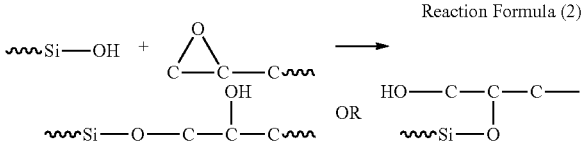

Coalesced silica used in the present invention may be prepared by preparing primary particle silica, and after this, aggregating the silica with a treatment using the silane-based treating agent or the epoxy-based treating agent, and may be used as a filler made of epoxy resin. Alternatively, it is also possible to prepare coalesced silica through one-stage reaction, by, for example, making the silane-based treating agent or the epoxy-based treating agent coexistent when synthesizing the silica by sol-gel method.

As the treating agent, the silane-based treating agent is preferred to the epoxy-based treating agent, because a Si—O—Si bond to be produced is more thermally stable than a Si—O—C bond.

Specific examples of the alkoxy silanes as the silane-based treating agent include tetramethoxy silane, tetraethoxy silane, methyltrimethoxy silane, methyltriethoxy silane, dimethyldimethoxy silane, dimethyldiethoxy silane, methyldimethoxy silane, methyldiethoxy silane, diphenyldimethoxy silane, isobutyltrimethoxy silane, and decyltrimethoxy silane.

Specific examples of the silane-based coupling agent as the silane-based treating agent include γ-aminopropyltriethoxysilane, γ-glycidoxypropyltrimethoxysilane, γ-glycidoxypropylmethyldiethoxysilane, γ-methacryloxypropyltrimethoxysilane, γ-mercaptopropyltrimethoxysilane, vinyltriethoxysilane, and methylvinyldimethoxysilane.

Specific examples of the silane-based treating agent other than the alkoxysilanes or the silane-based coupling agent include vinyltrichlorosilane, dimethyldichlorosilane, methylvinyldichlorosilane, methyl phenyl dichlorosilane, phenyltrichlorosilane, N,N'-bis(trimethylsilyl)urea, N,O-bis(trimethylsilyflacetamide, dimethyl trimethylsilyl amine, hexamethyldisilazane, and cyclicsilazane mixture.

Specific examples of the epoxy-based treating agent include a bisphenol A epoxy resin, a bisphenol F epoxy resin, a phenol novolak epoxy resin, a cresol novolak epoxy resin, a bisphenol A novolak epoxy resin, a biphenol epoxy resin, a glycidyl amine epoxy resin, and an alicyclic epoxy resin.

The coalesced silica used in the present invention is prepared by chemically bonding primary particles of crystalline silica, molten silica, or both thereof using the treating agent described above. In this treatment, primary particles of the silica are mixed with the treating agent at a mass ratio of (primary particles of silica:treating agent) of from 100:0.01 to 100:50 with a conventional mixer, e.g., a spray dryer.

At this time, for example, water or a 1% by mass acetic acid aqueous solution may be appropriately added as an auxiliary treating agent.

Then, the mixture of the primary particles of the silica and the treating agent is burned. The burning temperature is selected from a temperature range of from 100° C. to 2,500° C.

The burning time may be from 0.5 hour to 30 hours.

The degree of coalescence of the silica can be arbitrarily controlled by adjustment of the primary particle size and according to the kind, amount, and treating conditions of the treating agent.

That is, when producing silica by sol-gel method of obtaining primary particles of silica via a thermal dehydration reaction of a —(SiOH)n group site (n being from 4 to 1) caused by hydrolysis of a halogenated silano group or an alkoxy silano group, it is possible to change the particle diameter and shape of the primary particles by adjusting a hydrophilic solvent to be used, the amount of moisture, and the thermal dehydration temperature. It is possible to obtain primary particles having a large particle size and an aspherical shape, for example, by increasing the number of carbon atoms of alcohol in a hydrophilic solvent alcohol R—OH, by increasing the amount of ammonia water, or by raising the heating temperature. It is possible to obtain primary particles having an aspherical shape, for example, by adjusting the amount of moisture to be dropped for hydrolysis. Further, when producing secondary particles using the silane-based treating agent, it is possible to obtain secondary particles having a large particle diameter and an aspherical shape, for example, by using primary particles having a large average particle diameter or by using the silane-based treating agent in a large amount.

Further, the aggregating force is greater when the silane-based treating agent is used than when the epoxy-based treating agent is used, when the amount of the treating agent relative to the primary particles of silica is greater, or when the burning temperature is higher, resulting in a higher degree of coalescence.

The degree of coalescence is preferably from 2.0 to 4.0, and more preferably from 2.5 to 3.0. When the degree of coalescence is less than 2.0, the external additive is likely to be buried in the toner base particles, or the external additive is likely to roll into any dent, which may make it impossible to maintain transfer property and charge property. When the degree of coalescence is greater than 4.0, the external additive easily peel off from the toner, which cause carrier contamination to degrade the charge property or damage the photoconductor, which may result in image flaws by aging.

(Measurement of Degree of Coalescence)

The degree of coalescence can be measured by image observation. A sample is prepared by dispersing the coalesced silica in an appropriate solvent (e.g., THF), and after this, removing the solvent on a substrate to dry the silica. The obtained sample is observed with a field-emission scanning electron microscope (FE-SEM). The secondary particle diameter of the silica that is in the viewing field is measured at an accelerating voltage of from 5 kV to 8 kV at an observation magnification of from ×8 k to ×10 k.

The secondary particle diameter is obtained by measuring the maximum length of an aggregate of particles. FIG. 1 shows an example. The number of particles of the silica to be observed is 100 or more. In FIG. 1, the length of the arrow represents the secondary particle diameter.

Figure 2:
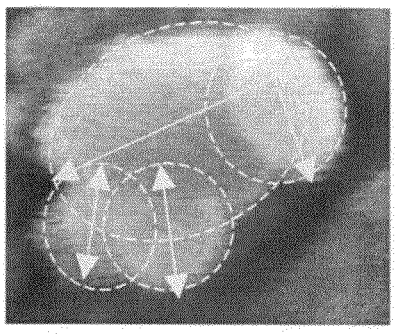
FIG. 2 is a diagram showing a maximum length of a whole image of each particle of coalesced silica, measured in the measurement of a degree of coalescence, by predicting the whole image of each particle including a buried portion thereof from the outer contour of the coalesced silica.

The primary particle diameter is likewise observed with the FE-SEM. From the outer contour of the coalesced silica, the whole image of each particle including the buried portion is predicted, and the maximum length of the whole image is measured. FIG. 2 shows an example. The average of the maximum lengths of the particles is used as the primary particle diameter. The number of particles of the silica to be observed is 100 or more. In FIG. 2, the average of the lengths of the arrows is the primary particle size.

The degree of coalescence can be calculated according to the following formula.

Degree of coalescence=(secondary particle size)−(primary particle size)

(Other Inorganic Particles Usable in Combination)

Other inorganic particles can be used in combination as the external additive for imparting flowability, developing property, charge property, etc. to the toner particles. The inorganic particles are not particularly limited and may be appropriately selected from conventional particles according to the purpose. Examples include fumed silica, alumina, titanium oxide, barium titanate, magnesium titanate, calcium titanate, strontium titanate, zinc oxide, tin oxide, silica sand, clay, mica, wollastonite, diatomaceous earth, chromium oxide, cerium oxide, red lead paint, antimony trioxide, magnesium oxide, zirconium oxide, barium sulfate, barium carbonate, calcium carbonate, silicon carbide, and silicon nitride. One of these may be used alone, or two or more of these may be used in combination.

(Non-Crystalline Polyester Resin)

In the present invention, a crystalline non-modified polyester resin and a non-crystalline polyester resin can be used as a component of the binder resin. A non-modified non-crystalline polyester resin can be used as the non-crystalline polyester resin.

The acid value of the non-modified polyester resin is typically from 1 KOHmg/g to 50 KOHmg/g, and preferably from 5 KOHmg/g to 30 KOHmg/g. Therefore, as the acid value is 1 KOHmg/g or greater, the toner tends to be charged negatively and have a favorable affinity with the sheet when fixed on the sheet, resulting in a better low temperature fixability. However, when the acid value is greater than 50 KOHmg/g, charge stability, especially, charge stability with respect to environmental fluctuations may be degraded.

In the present invention, the acid value of the non-modified polyester resin is preferably from 1 KOHmg/g to 50 KOHmg/g. The hydroxyl group value of the non-modified polyester resin is preferably 5 KOHmg/g or greater.

The hydroxyl group value is measured with a method compliant with JIS K0070-1966.

Specifically, first, a sample is precisely weighed with a measuring flask to be 0.5 g, and an acetylating reagent (5 mL) is added thereto. Then, the resultant is heated for 1 to 2 hours in a warm bath of 100±5° C., and the flask is taken out from the warm bath and left to be cooled. Then, water is added to the flask, and the flask is shaken to decompose acetic acid anhydride. Then, in order to completely decompose acetic acid anhydride, the flask is again heated for 10 minutes or longer in a warm bath and left to be cooled. Then, the wall of the flask is washed well with an organic solvent.

Then, with a potential difference automatic titrator DL-53 TITRATOR (manufactured by Mettler Toledo International Inc.) and an electrode DG113-SC (manufactured by Mettler Toledo International Inc), the hydroxyl group value is measured at 23° C., and analyzed with an analyzing software program LABX LIGHT VERSION 1.00.000. For calibration of the instrument, a mixture solvent of toluene (120 mL) and ethanol (30 mL) is used.

At this time, measuring conditions are as follows.

Stir
- Speed [%] of 25
- Time [s] of 15

EQP Titration
- Titrant/Sensor
- Titrant: $CH_3ONa$
- Concentration [mol/L] of 0.1
- Sensor DG115
- Unit of measurement: mV
- Predispensing to volume
- Volume [mL] of 1.0
- Wait time [s] of 0
- Titrant addition Dynamic
- dE (set) [mV] of 8.0
- dV (min) [mL] of 0.03
- dV (max) [mL] of 0.5
- Measure mode Equilibrium controlled
- dE [mV] of 0.5
- dt [s] of 1.0
- t (min) [s] of 2.0
- t (max) [s] of 20.0
- Recognition
- Threshold of 100.0
- Steepest jump only: No
- Range: No
- Tendency: None
- Termination
- at maximum volume [mL] of 10.0
- at potential: No
- at slope: No
- after number EQPs: Yes
  - n=1
- comb. Termination conditions: No
- Evaluation
- Procedure: Standard
- Potential 1: No
- Potential 2: No
- Stop for reevaluation: No The glass transition temperature (Tg) of the binder resin is not particularly limited and may be appropriately selected according to the purpose. However, it is preferably from 30° C. to 80° C., more preferably from 40° C. to 65° C.

When the glass transition temperature (Tg) is lower than 30° C., the heat resistant storage stability may be degraded. When it is higher than 80° C., the low temperature fixability may be degraded.

The weight average molecular weight (Mw) of the binder resin is not particularly limited and may be appropriately selected according to the purpose. However it is preferably from 2,000 to 90,000, more preferably from 2,500 to 30,000.

When the weight average molecular weight is less than 2,000, the heat resistant storage stability may be degraded. When it is greater than 90,000, the low temperature fixability may be degraded.

(Crystalline Polyester Resin)

For low temperature fixability, a crystalline polyester resin may be appropriately added. The crystalline polyester is not particularly limited and may be appropriately selected according to the purpose. Preferable examples thereof include those expressed by the structural formula (3) below.

Structural Formula (3)

$$-(O-CO-(CR^1=CR^2)_m-CO-O-R^3)_n-$$

(In the structural formula (3), m represents an integer of 1 or greater, preferably from 1 to 3. n represents degree of polymerization, and represents an integer of 1 or greater. $R^1$ and $R^2$ may be the same as or different from each other, and represent a hydrogen atom or a hydrocarbon group.)

The hydrocarbon group is not particularly limited and may be appropriately selected according tot the purpose. Examples thereof include alkyl group, alkenyl group, and aryl group.

These may be substituted for with a substituent group.

The alkyl group preferably contains 1 to 10 carbon atoms. Examples thereof include methyl group, ethyl group, n-propyl group, isopropyl group, n-butyl group, isobutyl group, sec-butyl group, n-hexyl group, isohexyl group, n-heptyl group, n-octyl group, isooctyl group, n-decyl group, and isodecyl group.

The alkenyl group preferably contains 2 to 10 carbon atoms. Examples thereof include vinyl group, allyl group, propenyl group, isopropenyl group, butenyl group, hexenyl group, and octenyl group.

The aryl group preferably contains 6 to 24 carbon atoms. Examples thereof include phenyl group, tolyl group, xylyl group, cumenyl group, styryl group, mesityl group, cinnamyl group, phenethyl group, and benzhydryl group.

In the structural formula (3), $R^3$ represents a divalent hydrocarbon group preferably containing 1 to 10 carbon atoms. Examples thereof include alkylene groups expressed by $-(CH_2)_p-$ (where p represents 1 to 10).

Among these, $-CH_2-$, $-CH_2CH_2-$, $-CH_2CH_2CH_2-$, $-CH_2C(CH_3)H-$, etc. are particularly preferable.

Crystallinity, molecular structure, etc of the crystalline polyester resin can be confirmed with NMR measurement, differential scanning calorimetry (DSC) measurement, X-ray diffraction measurement, GC/MS measurement, LC/MS measurement, infrared absorption (IR) spectrum measurement, etc.

For example, it is preferable that the crystalline polyester resin show adsorption due to δch (out-of-plane bending vibration) of olefin in infrared absorption (IR) spectra of 965±10 $cm^{-1}$ and 990±10 $cm^{-1}$. In this case, the sample showing this absorption can be evaluated as being crystalline.

The molecular weight distribution of the crystalline polyester resin is not particularly limited and may be appropriately selected according to the purpose. However, the molecular weight distribution is preferably sharp, and a lower molecular weight is more preferable because low temperature fixability is better. In a molecular weight distribution diagram obtained by gel permeation chromatograph (GPC) of a soluble content of orthodichlorobenzene and representing log (M) on the horizontal axis and % by mass on the vertical axis, it is preferable that a peak position be present in a range of from 3.5 to 4.0, and that the half value width be 1.5 or less.

The weight average molecular weight (Mw) of the crystalline polyester resin is not particularly limited and may be appropriately selected according to the purpose. For example, it is preferably fro 1,000 to 30,000, more preferably from 1,200 to 20,000.

When the weight average molecular weight is less than 1,000, the low temperature fixability may be degraded. When it is greater than 30,000, the sharp melt property may be degraded.

The number average molecular weight (Mn) of the crystalline polyester resin is not particularly limited and may be appropriately selected according to the purpose. For example, it is preferably from 500 to 6,000, more preferably from 700 to 5,500. When the number average molecular weight is less than 500, the low temperature fixability may be degraded. When it is greater than 6,000, the sharp melt property may be degraded.

The molecular weight distribution expressed as a ratio between the weight average molecular weight (Mw) and the number average molecular weight (Mn) is not particularly limited and may be appropriately selected according to the purpose. For example, it is preferably from 2 to 8. When the molecular weight distribution (Mw/Mn) is less than 2, production may be difficult and costly. When it is greater than 8, the sharp melt property may be degraded.

The melting temperature (Tm) of the crystalline polyester resin (may be referred to as "F1/2 temperature") is not particularly limited and may be appropriately selected according to the purpose. For example, it is preferably from 50° C. to 150° C., and more preferably from 60° C. to 130° C., when measured as DSC endothermic peak temperature in a DSC curve obtained by differential scanning calorimetry (DSC) measurement.

When the melting temperature (Tm) is lower than 50° C., the heat resistant storage stability may be degraded, and blocking is more likely to occur due to the temperature in the developing device. When it is higher than 150° C., the minimum fixing temperature may rise, and the low temperature fixability may not be obtained.

The acid value of the crystalline polyester resin is not particularly limited and may be appropriately selected according to the purpose. For example, it is preferably 5 mgKOH/g or greater, and more preferably 10 mgKOH/g or greater.

In terms of improving the hot offset resistance, the acid value is preferably 45 mgKOH/g or less. When the acid value is less than 5 mgKOH/g or less, it may not be possible to obtain affinity between paper and the resin, and the intended low temperature fixability.

The acid value of the crystalline polyester resin can be measured by, for example, dissolving the crystalline polyester resin in 1,1,1,3,3,3-hexafluoro-2-propanol and titrating it.

The hydroxyl group value of the crystalline polyester resin is not particularly limited and may be appropriately selected according to the purpose. For example, it is preferably from 0 mgKOH/g to 50 mgKOH/g, and more preferably from 5 mgKOH/g to 50 mgKOH/g. When the hydroxyl group value is greater than 50 mgKOH/g, it may not be possible to achieve a predetermined low temperature fixability and a preferable charge property.

The hydroxyl group value of the crystalline polyester resin can be measured by, for example, dissolving the crystalline polyester resin in 1,1,1,3,3,3-hexafluoro-2-propanol and titrating it.

The crystalline polyester resin can be synthesized by, for example, allowing a polycondensation reaction between an alcohol component and an acid component.

The alcohol component is not particularly limited and may be appropriately selected according to the purpose. Examples thereof include diol component.

The diol component preferably contains 2 to 8 carbon atoms, and more preferably 2 to 6 carbon atoms. Examples thereof include 1,4-butanediol, ethylene glycol, 1,2-propylene glycol, 1,3-propylene glycol, 1,6-hexanediol, neopentyl glycol, 1,4-butenediol, 1,5-pentanediol, and derivatives thereof.

One of these may be used alone, or two or more of these may be used in combination.

Among these, 1,4-butanediol and 1,6-hexanediol are preferable.

The amount of use of the diol compound is preferably 80 mol % or greater, and more preferably from 85 mol % to 100 mol % in the alcohol component.

When the content of the diol compound in the alcohol component is less than 80 mol %, the production efficiency may be degraded.

The acid component is not particularly limited and may be appropriately selected according to the purpose. Preferable examples thereof include carboxylic acid containing a carbon double bond, a dicarboxylic acid compound, and a polyvalent carboxylic acid compound. Among these, a dicarboxylic acid compound is preferable.

The dicarboxylic acid compound preferably contains 2 to 8 carbon atoms, and more preferably contains 2 to 6 carbon atoms. Examples thereof include oxalic acid, malonic acid, maleic acid, fumaric acid, citraconic acid, itaconic acid, glutaconic acid, succinic acid, adipic acid, anydrides of these acids, and alkyl ester of those above containing 1 to 3 carbon atoms.

One of these may be used alone, or two or more of these may be used in combination.

Among these, fumaric acid is preferable.

The amount of use of the dicarboxylic acid component is preferably 80 mol % or greater, and more preferably from 85 mol % to 100 mol % in the acid component.

When the content of the dicarboxylic acid component in the acid component is less than 80 mol %, the production efficiency may be degraded.

Examples of the polyvalent carboxylic acid compound include trimellitic acid, pyromellitic acid, anhydrides of these acids, and alkyl ester of these acids containing 1 to 3 carbon atoms.

The polycondensation reaction is not particularly limited and may be appropriately selected according to the purpose. For example, the polycondensation reaction can be performed under an inert gas atmosphere using an esterification catalyst, a polymerization inhibitor, etc. at from 120° C. to 230° C.

When performing the polycondensation reaction, it is possible to feed all of the monomers simultaneously with a view to improving the strength of the crystalline polyester resin to be obtained, or to allow divalent monomers to react first and then add trivalent or higher monomers and allow them to react with a view to reducing low-molecular-weight components, or to reduce the pressure of the reaction system in the latter half of the polycondensation reaction with a view to promoting the reaction, or to add trihydric or higher polyhydric alcohol such as glycerin as the alcohol component and add trivalent or higher polyvalent carboxylic acid such as trimellitic anhydride as the acid component during the polycondensation reaction to thereby obtain nonlinear polyester with a view to controlling the crystallinity and softening point of the crystalline polyester resin, or the like.

An example of the method for producing the crystalline polyester resin is as follows.

For example, a 5 L four-necked flask equipped with a nitrogen introducing pipe, a dehydrating pipe, a stirrer, and a thermocouple is charged with 1,4-butanediol, fumaric acid, trimellitic anhydride, and hydroquinone. They are reacted at 160° C. for 5 hours, and after this reacted for 1 hour at an elevated temperature of 200° C.

Then, they are reacted for 1 hour at a pressure of 8.3 kPa, to thereby synthesize a crystalline polyester resin.

Other than the non-modified polyester resin, a polyester resin modified with a chemical bond other than a urea bond, such as a polyester resin modified with a urethane bond, may be used in combination.

For adding a modified polyester resin such as a urea-modified polyester resin to the toner composition, the modified polyester resin can be produced by one-shot method or the like.

As one example, a method for producing a urea-modified polyester resin will be explained.

First, polyol and polycarboxylic acid are heated to 150° C. to 280° C. in the presence of a catalyst such as tetrabutoxy titanate and dibutyltin oxide. Water to be produced is removed while reducing the pressure if necessary, to thereby obtain a polyester resin containing a hydroxyl group. Then, the polyester resin containing the hydroxyl group and polyisocyanate are reacted at from 40° C. to 140° C. to obtain a polyester prepolymer containing an isocyanate group. The polyester prepolymer containing the isocyanate group is further reacted with amines at from 0° C. to 140° C., to thereby obtain a urea-modified polyester resin.

The number average molecular weight of the urea-modified polyester resin is typically from 1,000 to 10,000, and preferably from 1,500 to 6,000.

A solvent may be used according to necessity, for reacting the polyester resin containing the hydroxyl group and the polyisocyanate with each other, and for reacting the polyester prepolymer containing the isocyanate group and amines with each other.

Examples of the solvent include solvents inactive to an isocyanate group, such as: aromatic solvents (e.g., toluene and xylene); ketones (e.g., acetone, methyl ethyl ketone, and methyl isobutyl ketone); esters (e.g., ethyl acetate); amides (e.g., dimethylformamide and dimethylacetamide); and ethers (e.g., tetrahydrofuran).

When using the non-modified polyester resin in combination, it may be produced in the same manner as producing the polyester resin containing the hydroxyl group, and may be mixed in the solution resulting from the reaction for producing the urea-modified polyester resin.

In the present invention, a crystalline polyester resin, a non-crystalline polyester resin, a binder resin precursor, and a non-modified resin may be used in combination as binder resin components to be added in an oil phase. A binder resin component other than these resins may also be added. Preferable examples of the binder resin components include a polyester resin, and it is more preferable that the polyester resin be added in an amount of 50% by mass or greater. When the content of the polyester resin is less than 50% by mass, the low temperature fixability may be degraded. Particularly preferably, all of the binder resin components are polyester resins.

Examples of the binder resin components other than the polyester resin include: a polymer of styrene and a substituted product thereof, such as polystyrene, poly(p-chlorostyrene), and polyvinyl toluene; a styrene-based copolymer, such as a styrene-p-chlorostyrene copolymer, a styrene-propylene copolymer, a styrene-vinyltoluene copolymer, a styrene-vinylnaphthalene copolymer, a styrene-methyl acrylate copolymer, a styrene-ethyl acrylate copolymer, a styrene-butyl acrylate copolymer, a styrene-octyl acrylate copolymer, a styrene-methyl methacrylate copolymer, a styrene-ethyl methacrylate copolymer, a styrene-butyl methacrylate copolymer, a styrene-α-chloromethyl methacrylate copolymer, a styrene-acrylonitrile copolymer, a styrene-vinylmethylketone copolymer, a styrene-butadiene copolymer, a styrene-isoprene copolymer, a styrene-acrylonitrile-indene copolymer, a styrene-maleic acid copolymer, and a styrene-maleic acid ester copolymer; polymethyl methacrylate; polybutyl methacrylate; polyvinyl chloride; polyvinyl acetate; polyethylene; polypropylene; epoxy resin; epoxy polyol resin; polyurethane resin; polyamide resin; polyvinyl butyral; polyacrylic resin; rosin; modified rosin; terpene resin; aliphatic or alicyclic hydrocarbon resin; aromatic oil resin; aromatic oil; chlorinated paraffin; and paraffin wax.

Preferable examples of the binder resin components of the toner of the present invention include a binder resin precursor.

The toner of the present invention may be obtained by dissolving and dispersing at least a colorant, a releasing agent, a binder resin precursor made of a modified polyester resin, and the other binder resin components in an organic solvent to obtain an oil phase, dissolving a component that is to elongate or crosslink with the binder resin precursor in the oil phase, dispersing the oil phase in an aqueous medium containing a particle dispersant to obtain an emulsified dispersion liquid, allowing a crosslink reaction, an elongation reaction, or both thereof of the binder resin precursor in the emulsified dispersion liquid, and then removing the organic solvent.

It is preferable to obtain the toner base particles by dissolving or dispersing the binder resin, the binder resin precursor made of a modified polyester-based resin, a colorant, and a releasing agent in an organic solvent to obtain an oil phase, dissolving a compound that is to elongate or crosslink with the binder resin precursor in the oil phase, after this, dispersing the oil phase in an aqueous medium containing a particle dispersant to obtain an emulsified dispersion liquid, allowing a crosslink reaction, an elongation reaction or both thereof of the binder resin precursor in the emulsified dispersion liquid, and removing the organic solvent.

(Binder Resin Precursor)

The binder resin precursor is preferably a binder resin precursor made of a modified polyester-based resin. Examples thereof include a polyester prepolymer modified with an isocyanate group, an epoxy group, etc. This polyester prepolymer undergoes an elongation reaction with a compound containing an active hydrogen group (e.g., amines), and acts to improve a releasing width (i.e., the difference between the minimum fixing temperature and the temperature at which hot offset occurs). This polyester prepolymer can be easily synthesized by reacting a base polyester resin with a conventionally-known isocyanating agent, a conventionally-known epoxidation agent, or the like. Examples of the isocyanating agent include: aliphatic polyisocyanate (e.g., tetramethylenediisocyanate, hexamethylenediisocyanate, and 2,6-diisocyanatomethylcaproate); alicyclic polyisocyanate (e.g., isophorone diisocyanate, and cyclohexylmethanediisocyanate); aromatic diisocyanate (e.g., tolylenediisocyanate and diphenylmethanediisocyanate); aromatic aliphatic diisocyanate (e.g., $\alpha,\alpha,\alpha',\alpha'$-tetramethylxylylenediisocyanate); isocyanurates; products obtained by blocking the polyisocyanate with a phenol derivative, oxime, caprolactam, etc.; and combinations of 2 or more of these. Representative examples of the epoxidation agent include epichlorohydrin.

The ratio of the isocyanating agent expressed as an equivalent ratio [NCO]/[OH] of isocyanate group [NCO] to hydroxyl group [OH] of the base polyester is typically from 5/1 to 1/1, preferably from 4/1 to 1.2/1, and more preferably from 2.5/1 to 1.5/1. When [NCO]/[OH] is greater than 5, the low temperature fixability may be degraded. When the molar ratio of [NCO] is less than 1, the content of urea in the polyester prepolymer is low, which may degrade the hot offset resistance.

The content of the isocyanating agent in the polyester prepolymer is typically from 0.5% by mass to 40% by mass, preferably from 1% by mass to 30% by mass, and more preferably from 2% by mass to 20% by mass. When the content is less than 0.5% by mass, the hot offset resistance may be degraded, and satisfaction of both of the heat resistant storage stability and the low temperature fixability may be disadvantaged. When the content is greater than 40% by mass, the low temperature fixability may be degraded.

The number of isocyanate groups contained per polyester prepolymer molecule is typically 1 or more, preferably from 1.5 to 3 on the average, and more preferably from 1.8 to 2.5 on the average.

When the number of isocyanate groups is less than 1, the molecular weight of a urea-modified polyester resin resulting from the elongation reaction will be low, which degrades the hot offset resistance.

The weight average molecular weight of the binder resin precursor is preferably from $1\times10^4$ to $3\times10^5$.

(Compound Elongating or Crosslinking with Binder Resin Precursor)

Examples of the compound that is to elongate or crosslink with the binder resin precursor include compounds containing an active hydrogen group. Representative examples thereof include amines.

Examples of the amines include a diamine compound, a trivalent or higher polyamine compound, an amino alcohol compound, an amino mercaptan compound, an amino acid compound, and a compound obtained by blocking an amino group of these compounds.

Examples of the diamine compound include: aromatic diamine (e.g., phenylene diamine, diethyl toluene diamine, 4,4' diamino diphenyl methane); alicyclic diamine (e.g., 4,4'-diamino-3,3' dimethyl dicyclohexyl methane, diamine cyclohexane, and isophorone diamine); and aliphatic diamine (ethylene diamine, tetramethylene diamine, and hexamethylene diamine).

Examples of the trivalent or higher polyamine compound include diethylene triamine and triethylene tetramine.

Examples of the amino alcohol compound include ethanol amine and hydroxy ethyl aniline.

Examples of the amino mercaptan compound include amino ethyl mercaptan and amino propyl mercaptan.

Examples of the amino acid compound include amino propionic acid and amino caproic acid.

Examples of the compound obtained by blocking an amino group of the compounds listed so far include: a ketimine compound obtained from the amines and ketones (e.g., acetone, methyl ethyl ketone, and methyl isobutyl ketone); and an oxazoline compound.

Among these amines, the diamine compound, and a mixture of the diamine compound and a small amount of the polyamine compound.

(Colorant)

All of publicly-known dyes and pigments can be used as the colorant. Examples include carbon black, nigrosine dye, iron black, naphthol yellow S, Hansa yellow (10G, 5G, G), cadmium yellow, yellow iron oxide, yellow ocher, yellow lead, titanium yellow, polyazo yellow, oil yellow, Hansa yellow (GR, A, RN, R), pigment yellow L, benzidine yellow (G, GR), permanent yellow NCG, vulcan fast yellow (5G, R), tartrazinelake, quinoline yellow lake, anthrasan yellow BGL, isoindolinon yellow, colcothar, red lead, lead vermilion, cadmium red, cadmium mercury red, antimony vermilion, permanent red 4R, parared, fiser red, parachloroorthonitro anilin red, lithol fast scarlet G, brilliant fast scarlet, brilliant carmine BS, permanent red (F2R, F4R, FRL, FRLL and F4RH), fast scarlet VD, vulcan fast rubin B, brilliant scarlet G, lithol rubin GX, permanent red F5R, brilliant carmin 6B, pigment scarlet 3B, bordeaux 5B, toluidine Maroon, permanent bordeaux F2K, Helio bordeaux BL, bordeaux 10B, BON maroon light, BON maroon medium, eosin lake, rhodamine lake B, rhodamine lake Y, alizarin lake, thioindigo red B, thioindigo maroon, oil red, quinacridone red, pyrazolone red, polyazo red, chrome vermilion, benzidine orange, perinone orange, oil orange, cobalt blue, cerulean blue, alkali blue lake, peacock blue lake, victoria blue lake, metal-free phthalocyanin blue, phthalocyanin blue, fast sky blue, indanthrene blue (RS and BC), indigo, ultramarine, iron blue, anthraquinon blue, fast violet B, methylviolet lake, cobalt purple, manganese violet, dioxane violet, anthraquinon violet, chrome green, zinc green, chromium oxide, viridian, emerald green, pigment green B, naphthol green B, green gold, acid green lake, malachite green lake, phthalocyanine green, anthraquinon green, titanium oxide, zinc flower, lithopone, and mixtures of those above.

The content of the colorant is typically from 1% by mass to 15% by mass, and preferably from 3% by mass to 10% by mass relative to the toner.

The colorant may be synthesized with a resin and used as a master batch. Examples of a binder resin to be used for production of a master batch or to be kneaded with a master batch include: the modified and non-modified polyester resins listed above; a polymer of styrene and a substituted product thereof, such as polystyrene, poly(p-chlorostyrene), and polyvinyl toluene; a styrene-based copolymer, such as a styrene-p-chlorostyrene copolymer, a styrene-propylene copolymer, a styrene-vinyltoluene copolymer, a styrene-vinylnaphthaline copolymer, a styrene-methyl acrylate copolymer, a styrene-ethyl acrylate copolymer, a styrene-butyl acrylate copolymer, a styrene-octyl acrylate copolymer, a styrene-methyl methacrylate copolymer, a styrene-ethyl methacrylate copolymer, a styrene-butyl methacrylate copolymer, a styrene-α-chloromethyl methacrylate copolymer, a styrene-acrylonitrile copolymer, a styrene-vinylmethylketone copolymer, a styrene-butadiene copolymer, a styrene-isoprene copolymer, a styrene-acrylonitrile-indene copolymer, a styrene-maleic acid copolymer, and a styrene-maleic acid ester copolymer; polymethyl methacrylate; polybutyl methacrylate; polyvinyl chloride; polyvinyl acetate; polyethylene; polypropylene; polyester; epoxy resin; epoxy polyol resin; polyurethane resin; polyamide resin; polyvinyl butyral; polyacrylic resin; rosin; modified rosin; terpene resin; aliphatic or alicyclic hydrocarbon resin; aromatic oil resin; aromatic oil; chlorinated paraffin; and paraffin wax. These may be used alone or in a mixture.

The present master batch can be produced by mixing and kneading a resin for the master batch and the colorant under a high shear force. At this time, an organic solvent may be used for enhancing the interaction between the colorant and the resin. A so-called flushing method of mixing and kneading an aqueous paste of the colorant, which contains water, with the resin and an organic solvent to transfer the colorant to the resin, and then removing the water and the organic solvent component is preferably used, because this method can use a wet cake of the colorant without any treatment and hence needs no drying. A high-shear-force dispersing device such as a three-roll mill is preferably used for mixing and kneading.

(Releasing Agent)

The releasing agent is preferably a wax having a melting point of from 50° C. to 120° C.

Such a wax can effectively act as a releasing agent at the interface between the fixing roller and the toner. Therefore, it can improve the high temperature offset resistance without the need for coating the fixing roller with a releasing agent such as oil.

The melting point of the wax can be obtained by measuring the maximum endothermic peak with a differential scanning calorimeter TG-DSC SYSTEM TAS-100 (manufactured by Rigaku Corporation).

The following materials can be used as the releasing agent.

Examples of brazing materials and waxes include: plant waxes such as carnauba wax, cotton wax, vegetable wax, and rice wax; animal waxes such as bees wax and lanolin; mineral waxes such as ozokerite and ceresine; and petroleum waxes such as paraffin, microcrystalline, and petrolatum.

Examples of the releasing agent other than these natural waxes include: synthetic hydrocarbon waxes such as Fischer-Tropsch wax and ethylene wax; and synthetic waxes such as ester, ketone, and ether.

Other examples of the releasing agent include: fatty acid amides such as 1,2-hydroxy stearic acid amide, stearic acid amide, phthalic imide anhydride, and chlorinated hydrocarbon; and crystalline polymers containing a long-chain alkyl group in a side chain thereof, such as a homopolymer or a copolymer of polyacrylate such as n-stearyl polymethacrylate and n-lauryl polymethacrylate, which are low-molecular-weight crystalline polymers (e.g., n-stearyl acrylate-ethyl methacrylate copolymer).

The toner may contain a charge controlling agent according to necessity. The charge controlling agent may be a conventionally-known charge controlling agent. Examples thereof include: nigrosine dyes, triphenylmethane dyes, chromium-containing metal complex dyes, molybdic acid chelate pigments, rhodamine dyes, alkoxy amines, quaternary ammonium salt (including fluorine-modified quaternary ammonium salts), alkyl amides, elemental phosphorus or phosphorus compounds, elemental tungsten or tungsten compounds, fluorine surfactants, metal salts of salicylic acid, and metal salts of salicylic acid derivatives.

Specific examples include: BONTRON 03 of a nigrosine dye, BONTRON P-51 of a quaternary ammonium salt, BONTRON S-34 of a metal-containing azo dye, E-82 of oxynaphthoic acid metal complex, E-84 of salicylic acid metal complex and E-89 of phenol condensate (manufactured by Orient Chemical Industries Co., Ltd.); TP-302 and TP-415 of quaternary ammonium salt molybdenum complexes (manufactured by Hodogaya Chemical Co., Ltd.); Copy Charge PSY VP2038 of quaternary ammonium salt, Copy Blue PR of triphenylmethane derivative, Copy Charge NEG VP2036 and Copy Charge NX VP434 of quaternary ammonium salts (manufactured by Hoechst AG); LRA-901, and LR-147 of boron complex (manufactured by Carlit Japan Co., Ltd.); copper phthalocyanine, perylene, quinacridone, azo pigments, and other polymeric compounds having functional groups such as sulfonic acid group, carboxyl group, and quaternary ammonium salt.

The content of the charge controlling agent is determined based on types of the binder resin, presence or absence of additives used according to necessity, and toner manufacturing methods including dispersion methods, and it is not determined flatly. Nonetheless, it is preferably used in the range of from 0.1 parts by mass to 10 parts by mass relative to 100 parts by mass of the binder resin. The range is preferably from 0.2 parts by mass to 5 parts by mass. When the content exceeds 10 parts by mass, charge property of the toner is too large, reducing an effect of the main charge controlling agent and increasing an electrostatic attraction force with a developing roller, which may result in decreased fluidity of the developer and decreased image density. These charge controlling agents may be melt-kneaded with the master batch and the resin, and then dissolved and dispersed. They may of course be added directly to the organic solvent in dissolving and dispersing, or they may be fixed on the surface of the toner after the toner particles are produced.

(Method for Producing Toner in Aqueous Medium)

The aqueous medium may be water alone, but a solvent miscible with water may be used in combination. Examples of the solvent miscible with water include alcohols (e.g. methanol, isopropanol, and ethylene glycol), dimethylformamide, tetrahydrofuran, cellosolves (e.g., methyl cellosolve), and lower ketones (e.g., acetone and methyl ethyl ketone).

It is possible to mix the binder resin precursor, the colorant, the releasing agent, a crystalline polyester dispersion liquid, the charge controlling agent, the non-modified polyester resin, etc. that are to constitute the toner base particles, when forming a dispersion in the aqueous medium. However, it is more preferable to mix these toner materials in advance, and then add them to the aqueous medium and disperse them therein. In the present invention, it is not indispensable to add toner materials such as the colorant, the releasing agent, and the charge controlling agent when forming particles in the aqueous medium, but it is possible to add them after particles are formed. For example, it is possible to add the colorant according to a publicly-known dyeing method, after particles free from the colorant are formed.

The method for dispersion is not particularly limited, but publicly-known equipment such as a low-speed shearing type, a high-speed shearing type, a friction type, a high-pressure jetting type, and an ultrasonic type can be used. A high-speed shearing type is preferable in order to obtain a dispersion having a particle diameter of from 2 μm to 20 μm. When using a high-speed sharing type, the rotation speed is not particularly limited, but is typically from 1,000 rpm to 30,000 rpm, and preferably from 5,000 rpm to 20,000 rpm. The dispersion time is not particularly limited, but is typically from 0.1 minutes to 60 minutes when a batch scheme is employed. The temperature during dispersion is typically from 0° C. to 80° C. (under an applied pressure), and preferably from 10° C. to 40° C.

The amount of use of the aqueous medium relative to 100 parts by mass of the toner composition is typically from 100 parts by mass to 1,000 parts by mass. When it is less than 100 parts by mass, the toner composition will not be dispersed well, and toner base particles having a predetermined particle diameter will not be obtained. When the amount of use is greater than 1,000 parts by mass, it is not economical. Further, a dispersant may be used according to necessity. It is more preferable to use a dispersant, because it will make the particle size distribution sharper and allow stable dispersion.

The polyester prepolymer and the compound containing an active hydrogen group may be reacted by adding the compound containing an active hydrogen group to the aqueous medium before dispersing the toner composition therein and allowing them to react, or by dispersing the toner composition in the aqueous medium, and after this, adding the compound having an active hydrogen group to allow the reaction to start from the interface of the particles. In the latter case, it is possible to provide a concentration gradient inside the particles, with modified polyester to be derived from the polyester prepolymer deposited preferentially on the surface of the toner to be obtained.

Examples of a dispersant for emulsifying and dispersing in a liquid containing water, the oil phase in which the toner composition is dispersed include: anionic surfactants such as alkylbenzene sulfonate, α-olefin sulfonate, and phosphoric acid ester; cationic surfactants of an amine salt type such as alkylamine salt, amino alcohol fatty acid derivative, polyaminefatty acid derivative, and imidazoline, cationic surfactants of a quaternary ammonium salt type such as alkyltrimethyl ammonium salt, dialkyldimethyl ammonium salt, alkyldimethylbenzyl ammonium salt, pyridinium salt, alkyl iso-quinolinium salt, and benzethonium chloride; non-ionic surfactants such as fatty acid amide derivative and polyhydric alcohol derivative; and amphoteric surfactants such as alanine, dodecyldi(aminoethyl)glycine, di(octyl aminoethyl)glycine, and N-alkyl-N,N-dimethyl ammonium betaine.

Also, use of a surfactant having a fluoroalkyl group even in a very small amount can increase an effect thereof. Favorable examples of anionic surfactants having a fluoroalkyl group include: fluoroalkylcarboxylic acid having 2 to 10 carbon atoms and metal salts thereof, disodium perfluorooctane sulfonylglutamate, sodium 3-[ω-fluoroalkyl (C6 to C11) oxy]-1-alkyl (C3 to C4) sulfonate, sodium 3-[ω-fluoroalkanoyl (C6 to C8)-N-ethylamino]-1-propanesulfonate, fluoroalkyl (C11 to C20) carboxylic acid and a metal salt thereof, perfluoroalkylcarboxylic acid (C7 to C13) and metal salts thereof, perfluoroalkyl (C4 to C12) sulfonic acid and metal salts thereof, perfluorooctanesulfonic acid diethanolamide, N-propyl-N-(2-hydroxyethyl)perfluorooctanesulfonamide, perfluoroalkyl (C6 to C10) sulfonamidepropyltrimethylammonium salt, perfluoroalkyl (C6 to C10)-N-ethylsulfonylglycine salt, and monoperfluoroalkyl (C6 to C16) ethylphosphoric acid ester.

As product names, SURFLON S-111, S-112, S-113 (manufactured by Asahi Glass Co., Ltd.), FLUORAD FC-93, FC-95, FC-98, FC-129 (manufactured by Sumitomo 3M Ltd.), UNIDYNE DS-101, DS-102 (manufactured by Daikin Industries, Ltd.), MEGAFACE F-110, F-120, F-113, F-191, F-812, F-833 (manufactured by DIC Corporation), EFTOP EF-102, 103, 104, 105, 112, 123A, 123B, 306A, 501, 201, 204 (manufactured by Tochem Products Inc.), and FTERGENT F-100, F150 (manufactured by Neos Company Ltd.) are exemplified.

Also, examples of cationic surfactants include: aliphatic quaternary ammonium salts such as aliphatic primary, secondary or tertiary amine acid having a fluoroalkyl group and perfluoroalkyl (C6 to C10) sulfonamidepropyl trimethyl ammonium salt, benzalkonium salts, benzethonium chloride, pyridinium salts, imidazolinium salts, and as commercial products, SURFLON S-121 (manufactured by Asahi Glass Co., Ltd.), FLUORAD FC-135 (manufactured by Sumitomo 3M Ltd.), UNIDYNE DS-202 (manufactured by Daikin Industries, Ltd.), MEGAFACE F-150, F-824 (manufactured by DIC Corporation), EFTOP EF-132 (manufactured by Tochem Products Inc.), and FTERGENT F-300 (manufactured by Neos Company Ltd.).

Also, as an inorganic compound dispersant which is poorly soluble in water, tricalcium phosphate, calcium carbonate, titanium oxide, colloidal silica, hydroxyapatite and so on may also be used.

Also, dispersed droplets may be stabilized by a polymeric protective colloid or water-insoluble organic fine particles. Examples thereof include: acids such as acrylic acid, methacrylic acid, α-cyanoacrylic acid, α-cyanomethacrylic acid, itaconic acid, crotonic acid, fumaric acid, maleic acid, and maleic anhydride or (meth)acrylic monomer including a hydroxyl group such as β-hydroxyethyl acrylate, β-hydroxyethyl methacrylate, β-hydroxypropyl acrylate, β-hydroxypropyl methacrylate, γ-hydroxypropyl acrylate, γ-hydroxypropyl methacrylate, 3-chloro-2-hydroxypropyl acrylate, 3-chloro-2-hydroxypropyl methacrylate, diethylene glycol monoacrylate, diethylene glycol monomethacrylate, glycerin monoacrylate, glycerin monomethacrylate, N-methylol acrylamide, and N-methylol methacrylamide; vinyl alcohols or ethers with vinyl alcohol, such as vinyl methyl ether, vinyl ethyl ether, and vinyl propyl ether; esters of vinyl alcohol and a compound having a carboxyl group, such as vinyl acetate, vinyl propionate, and vinyl butyrate; acrylamide, methacrylamide, and diacetone acrylamide and methylol compounds thereof; acid chlorides such as acrylic acid chloride, and methacrylic acid chloride; homopolymers or copolymers such as those having a nitrogen atom or a heterocyclic ring thereof, such as vinyl pyridine, vinyl pyrrolidone, vinyl imidazole and ethylene imine; polyoxyethylenes such as polyoxyethylene, polyoxypropylene, polyoxyethylene alkyl amine, polyoxypropylene alkyl amine, polyoxyethylene alkyl amides, polyoxypropylene alkyl amides, polyoxyethylene nonylphenyl ether, polyoxyethylene laurylphenyl ether, polyoxyethylene stearylphenyl ester, and polyoxyethylene nonylphenyl ester; and celluloses such as methyl cellulose, hydroxyethyl cellulose, and hydroxypropyl cellulose.

Here, when an acid- or alkali-soluble compound such as calcium phosphate is used as the dispersion stabilizer, calcium phosphate may be removed from the fine particles by dissolving calcium phosphate by an acid such as hydrochloric acid and then by rinsing the particles with water. It may also be removed by other operations such as enzymatic decomposition.

In a case where the dispersant is used, the dispersant may be left remaining on the surface of the toner particles, but it is preferably removed by washing after reaction in view of charging of the toner.

Further, in order to reduce viscosity of the toner composition, a solvent that can dissolve polyester and is obtained from the polyester prepolymer that is modified through reaction may be used. Use of the solvent is more preferable in view of sharp particle size distribution. The solvent preferably has volatility with a boiling point of less than 100° C. for easier removal. As the solvent, water-miscible solvents such as toluene, xylene, benzene, carbon tetrachloride, methylene chloride, 1,2-dichloroethane, 1,1,2-trichloroethane, trichlorethylene, chloroform, monochlorobenzene, dichloroethylidene, methyl acetate, ethyl acetate, methyl ethyl ketone, methyl isobutyl ketone, tetrahydrofuran, and methanol may be used alone, or two or more these may be used in combination.

Especially, aromatic solvents such as toluene and xylene and halogenated hydrocarbons such as methylene chloride, 1,2-dichloroethane, chloroform, and carbon tetrachloride are preferable. The amount of use of the solvent with respect to 100 parts by mass of the polyester prepolymer is usually from 0 part by mass to 300 parts by mass, preferably from 0 part by mass to 100 parts by mass, and further preferably from 25 parts by mass to 70 parts by mass. When the solvent is used, it is removed by heating under a normal pressure or a reduced pressure after elongation reaction, crosslinking reaction, or both thereof.

The reaction time for elongation reaction, crosslinking reaction, or both thereof is selected according to reactivity based on the combination of the polyester prepolymer and the compound containing an active hydrogen group. Nonetheless, it is usually from 10 minutes to 40 hours, and preferably from 30 minutes to 24 hours. The reaction temperature is usually form 0° C. to 100° C., and preferably from 10° C. to 50° C. Also, a heretofore known catalyst may be used according to necessity. Specific examples thereof include tertiary amines such as triethylamine, and imidazole.

In order to remove the organic solvent from the obtained emulsified dispersion, a method to heat the whole system gradually to remove the organic solvent in the liquid droplets completely by evaporation may be used. Alternatively, the emulsified dispersion may be sprayed in a dry atmosphere to completely remove the water-insoluble organic solvent in the liquid droplets to thereby form toner fine particles while removing the aqueous dispersant by evaporation. As the dry atmosphere in which the emulsified dispersion is sprayed, a gas of heated air, nitrogen, carbon dioxide, and combustion gas, and especially various gas flows heated to a temperature equal to or above the boiling point of the solvent having the highest boiling point of all the solvents used are generally used. A desired quality may be obtained sufficiently in a processing of a short time with a spray dryer, a belt dryer, rotary kiln and so on.

There are cases where a wide particle size distribution during emulsification and dispersion is maintained and washing and drying steps are carried out with the particle size distribution. In this case, the particle size distribution may be adjusted by classification to a desired particle size distribution.

By the classification operation, fine-particle portions may be removed in a liquid by a cyclone, a decanter, a centrifugation and so on. It is of course possible to carry out the classification operation after obtaining powder after drying, it is more preferable to do so in a liquid in view of efficiency. The resulting fine particles or coarse particles not needed may be returned to a kneading step and used for particle formation again. In that case, the fine particles or the coarse particles may be wet.

It is preferable that the dispersant used is removed from the obtained dispersion liquid as much as possible, and it is preferably done at the same time as the classification operation described hereinabove.

Heterogeneous particles such as releasing-agent fine particles, charge-controlling fine particles, fluidizing fine particles, colorant fine particles and so on may be mixed with the obtained toner powder after drying, or a mechanical impact is applied to the mixed powder. Thereby, the heterogeneous particles are fixed or fuxed on the surface of the toner particles, and it is possible to prevent the heterogeneous particles from departing the obtained composite particles.

Specifically, there are methods to apply an impact force to a mixture using blades rotating at high speed, a method to feed the mixture in a high-speed airflow, which is accelerated to have the particles collide with one another or against a suitable collision plate and so on. Examples of apparatuses include ANGMILL (manufactured by Hosokawa Micron Co., Ltd.), a remodeled apparatus of I-TYPE MILL (manufactured by Nippon Pneumatic Mfg. Co.) with a reduced grinding air pressure, HYBRIDIZATION SYSTEM (manufactured by Nara Kikai Seisakusho Co., Ltd.), KRYPTRON SYSTEM (manufactured by Kawasaki Heavy Industries, Ltd.), and an automatic mortar.

(Cleaning Property Improver)

A cleaning property improver is an agent that is added to the toner so that the developer after transferred that remains on the photoconductor or a primary transfer medium may be removed. Examples thereof include: metal salts of fatty acids, such as zinc stearate, calcium stearate, and stearic acid; and polymer particles manufactured by soap-free emulsion polymerization, such as polymethyl methacrylate particles and polystyrene particles. The polymer particles preferably have a relatively narrow particle size distribution and a volume average particle size of from 0.01 μm to 1 μm.

(Carrier)

A carrier to be used in the present invention will now be described specifically.

The basic structure of the carrier of the present invention includes core material particles having a magnetic property and a resin layer coating the surface of the core material particles. Selection of the particle diameter of the carrier and of the core material particles to be the framework of the carrier is important. The carrier to be used in the developing method of the present invention has a weight average particle diameter Dw in a range of from 20 μm to 45 μm. When the weight average particle diameter Dw is greater than this range, it is less likely for carrier adhesion to occur, but the toner may be developed less truly to the electrostatic latent image, there may occur greater unevenness in the dot diameter, and the particle state (roughness) may be degraded.

When a carrier having a weight average particle diameter Dw of less than 20 μm is used, poorly-magnetized particles may be present all over the magnetic brush, which may result in an abrupt escalation of carrier adhesion.

Further, when the carrier particles having a weight average particle diameter Dw of from 22 μm to 32 μm are coated with a resin having a sharp particle size distribution in which the content of particles less than 36 μm is 80% by mass or greater and more preferably 82% by mass or greater, and the content of particles less than 44 μm is 90% by mass or greater, there will be less unevenness in the level of magnetization among the carrier particles, which will lead to significant improvement of carrier adhesion when a developing method of applying a direct bias is employed.

Particularly, when the carrier is coated with a resin having a sharp particle size distribution in which the content of particles having a particle diameter of less than 20 μm is from 0% by mass to 7% by mass, the content of particles less than 36 μm is from 80% by mass to 100% by mass, and the content of particles less than 44 μm is from 90% by mass to 100% by mass, there will be less unevenness in the level of magnetization among the carrier particles, which will lead to significant improvement of carrier adhesion.

Further, when the carrier particles having a weight average particle diameter Dw of from 22 μm to 32 μm are coated with a resin having a sharp particle size distribution in which the content of particles less than 36 μm is 80% by mass or greater and more preferably 82% by mass or greater, and the content of particles less than 44 μm is 90% by mass or greater, there will be less unevenness in the level of magnetization among the carrier particles, which will lead to significant improvement of carrier adhesion when a developing method of applying a direct bias is employed.

Furthermore, it is more preferable that the particle size distribution of the carrier used in the present invention be sharper with a more uniform particle diameter. In addition to being constrained as to the weight average particle diameter Dw as described above, the carrier and carrier core material particles are preferably constrained as to number average particle diameter Dp.

In the present invention, a microtrack granulometer (Model HRA9320-X100, manufactured by Honewell International Inc.) is used a granulometer for measuring the particle size distribution.

The carrier of the present invention needs to be magnetized to a predetermined level because of the necessity for forming a magnetic brush. The amount of such magnetization of the carrier is from 40 emu/g to 100 emu/g, and more preferably from 50 emu/g to 90 emu/g, when a magnetic field of 1,000 oersted (Oe) is applied to the carrier. When the amount of magnetization is less than 40 emu/g, it is more likely for carrier adhesion to occur. When it is 100 emu/g or greater, the chain-like trails of the magnetic brush may be severer.

The amount of magnetization can be measured as follows. A B-H tracer (BHU-60 manufactured by Riken Denshi Co., Ltd.) is used. A cylindrical cell is packed with 1 g of carrier core material particles, and set in the instrument. A magnetic field is gradually increased up to 3,000 oersted, and then gradually reduced to zero. After this, a magnetic field in an opposite direction is gradually increased up to 3,000 oersted, and then gradually reduced to zero. After this, a magnetic field is applied in the same direction as the first direction. In this way, a B-H curve is plotted, and a magnetic moment of 1,000 oersted is calculated from the curve.

The amount of magnetization of such a carrier depends basically on the magnetic material used as the core material particles. Examples of the core material particles used in the carrier of the present invention and magnetized in an amount of 40 emu/g or greater when a magnetic field of 1,000 oersted is applied include ferromagnetic materials such as iron and cobalt, magnetite, hematite, Li-based ferrite, MnZn-based ferrite, CuZn-based ferrite, NiZn-based ferrite, Ba-based ferrite, and Mn-based ferrite.

The core material particles used in the carrier of the present invention can be obtained by classifying particles obtained by crushing a magnetic material, or when a core material such as ferrite and magnetite is used, by classifying particles obtained by burning a primary granular product of such a material after classifying the product, with a classifying operation to particle materials with different particle size distributions, and the mixing the plurality of particle materials.

The method for classifying the core material particles may be conventionally-known classification methods such as a sieving device, a gravitational classifier, a centrifugal classifier, and an inertia classifier. Use of a wind-force classifier such as a gravitational classifier, a centrifugal classifier, and an inertia classifier is preferable, because they have a good productivity and easily allow change of the classification point.

The electrical resistivity (log R) of the carrier of the present invention is preferably in the range of from 11.0 Ω·cm to 17.0 Ω·cm, and more preferably in the range of from 11.5 Ω·cm to 16.5 Ω·cm. When the resistivity log R of the carrier is less than 11.0 Ω·cm, it is likely for carrier adhesion to occur with charges induced in the carrier when a developing gap (i.e., the closest approaching distance between the photoconductor and the developing sleeve) becomes narrow. When the resistivity is greater than 17.0 Ω·cm, there occurs a greater edge effect to reduce the image density of a solid image portion. When the resistivity log R is greater than 17.0 Ω·cm, it becomes likely for charges having an opposite polarity to the toner to build up, with which the carrier is electrically charged to make it likely for carrier adhesion to occur.

The resistivity of the carrier can be adjusted by adjusting the resistance of the resin coating the core material particles and by controlling the thickness of the coating layer. It is also possible to use and add electro-conductive particles in the resin coating layer in order to adjust the carrier resistance. Examples of the electro-conductive particles include: metals such as electro-conductive ZnO and Al or metal oxides such as cerium oxide, alumina, and, e.g., $SiO_2$ and $TiO_2$ that are surface-hydrophobized; $SnO_2$ prepared by various methods or $SnO_2$ doped with various elements; borides such as $TiB_2$, $ZnB_2$, and $MoB_2$; silicon carbide; electro-conductive polymers such as polyacethylene, polyparaphenylene, poly(paraphnylene sulfide)polypyrrole, and polyethylene; and carbon blacks such as furnace black, acethylene black, and channel black.

Such electro-conductive particles may be prepared by the following method. Specifically, the electro-conductive particles are added to a solvent used for coating or to a coating resin liquid, and then uniformly dispersed therein with a dispersing device using media such as a ball mill and a beads mill, or with a stirrer equipped with a high-speed rotating blade, to prepare a coating layer forming dispersion liquid. The core material particles are coated with this coating layer forming dispersion liquid to thereby obtain the carrier.

The resin used in the carrier coating layer may be any of conventionally-known resins, but is preferably a silicone resin.

In the present invention, a straight silicone resin can be used as the silicone resin. Examples thereof include KR271, KR272, KR282, KR252, KR255, and KR 152 (manufactured by Shin-Etsu Chemical Co., Ltd.), and SR2400 and SR2406 (manufactured by Dow Corning Toray Silicone Co., Ltd.).

In the present invention, a modified silicone resin can be used as the silicone resin. Examples thereof include epoxy-modified silicone, acrylic-modified silicone, phenol-modified silicone, urethane-modified silicone, polyester-modified silicone, and alkyd-modified silicone. Specific examples of the modified silicone include an epoxy-modified product EX-1001N, an acrylic-modified silicone KR-5208, a polyester-modified product KR-5203, an alkyd-modified product KR-206; and a urethane-modified product KR-305 (all of the above manufactured by Shin-Etsu Chemical Co., Ltd.), and an epoxy-modified product SR2115 and an alkyd-modified product SR2110 (both manufactured by Dow Corning Toray Silicone Co., Ltd.).

Further, in the present invention, the resins to be shown below may be used as mixed with the silicone resin listed above.

Examples of the resins preferably used and mixed with the silicone resin listed above include: styrene-based resins such as polystyrene, chloropolystyrene, poly-α-methylstyrene, styrene-chlorostyrene copolymer, styrene-propylene copolymer, styrene-butadiene copolymer, styrene-vinyl chloride copolymer, styrene-vinyl acetate copolymer, styrene-maleic acid copolymer, styrene-acrylic acid ester copolymer (e.g., styrene-methyl acrylate copolymer, styrene-ethyl acrylate copolymer, styrene-butyl acrylate copolymer, styrene-octyl acrylate copolymer, and styrene-phenyl acrylate copolymer), styrene-methacrylic acid ester copolymer (e.g., styrene-methyl methacrylate copolymer, styrene-ethyl methacrylate copolymer, styrene-butyl methacrylate copolymer, and styrene-phenyl methacrylate copolymer), styrene-α-methyl chloroacrylate copolymer, and styrene-acrylonitrile-acrylic acid ester copolymer; epoxy resin; polyester resin; polyethylene resin; polypropylene resin; ionomer resin; polyurethane resin; ketone resin; ethylene-ethyl acrylate copolymer; xylene resin; polyamide resin; phenol resin; polycarbonate resin; melamine resin; and fluorine-based resin.

In the present invention, a carrier having a favorable durability can be obtained by adding an amino silane coupling agent in the coating layer made of the silicone resin.

The amount of the amino silane coupling agent used in the present invention is preferably from 0.001% by mass to 30% by mass. The method for forming the resin coating layer on the surface of the carrier core material particles may be any of publicly-known methods such as spray drying, immersing, and powder coating. Particularly, a method using a fluid bed coater is effective for forming a uniform coating layer.

The thickness of the coating layer on the surface of the carrier core material particles is typically from 0.02 μm to 1 μm, and preferably from 0.03 μm to 0.8 μm. Because the thickness of the coating layer is very small, the particle diameter of the carrier having the coating layer formed on the surface of the core material particles is substantially the same as the particle diameter of the core material particles of the carrier.

In this case, the bulk density of the carrier influences carrier adhesion. The bulk density encouraged in the present invention is from 2.15 g/cm$^3$ to 2.70 g/cm$^3$, and more preferably from 2.25 g/cm$^3$ to 2.60 g/cm$^3$. When the carrier is porous or has great undulations on the surface to have a bulk density of less than 2.15, even when the amount of magnetization (emu/g) of the core material particles when 1 KOe is applied is large, a substantial amount of magnetization per particle is small, which is disadvantageous against carrier adhesion.

The burning temperature may be raised to increase the bulk density, which would however make it likely for the core material particles to adhere to each other by melting, to make themselves harder to crush and separate. Therefore, the bulk density is preferably less than 2.7 g/cm$^3$, and more preferably less than 2.6 g/cm$^3$.

The bulk density of the carrier of the present invention is defined according to Metal Particles-Bulk Density Testing Method (JIS-Z-2504). According to this method, the carrier is naturally discharged through an orifice having a diameter of 2.5 mm into a 25 cm$^3$ stainless-made cylindrical container that is put immediately below, until the container overflows with the carrier. After this, the top surface of the container is flatly scraped off with a plane spatula in one operation along the top end of the container. When it is hard for the carrier to flow through the orifice having a diameter of 2.5 mm, the carrier is naturally discharged through an orifice having a diameter of 5 mm. The weight of the carrier flowed into the container by this operation is divided by the volume of the container of 25 cm$^3$, to thereby calculate the weight of the carrier per 1 cm$^3$. This is defined as the bulk density of the carrier.

(Image Forming Apparatus and Image Forming Method)

An image forming method of the present invention includes an electrostatic latent image forming step (a charging step and an exposing step), a developing step, a transfer step, a fixing step, and a cleaning step, and may further include steps such as a charge eliminating step, a recycling step, and a controlling step according to necessity.

An image forming apparatus of the present invention include an image bearing member, an electrostatic latent image forming unit, a developing unit, a transfer unit, a fixing unit, and a cleaning unit, and may further include units such as a charge eliminating unit, a recycling unit, and a control unit according to necessity.

The image forming method will be explained below in detail, while also explaining the image forming apparatus of the present invention.

The electrostatic latent image forming step is a step of forming an electrostatic latent image on an image bearing member. The material, shape, structure, size, etc. of the image bearing member may be selected from publicly-known designs. Examples of the material include inorganic substances such as amorphous silicon and selenium, and organic substances such as polysilane and phthalopolymethine. Amorphous silicon is preferable because is has a long life. The shape is preferably a drum shape. An electrostatic latent image can be formed by electrically charging the surface of the image bearing member uniformly, and then exposing the surface of the image bearing member to light imagewise, and this can be performed by the electrostatic latent image forming unit. The electrostatic latent image forming unit preferably includes a charging device (a charging unit) configured to electrically charge the surface of the image bearing member uniformly, and an exposing device (an exposing unit) configured to expose the surface of the image bearing member to light.

Charging can be performed by applying a voltage to the surface of the image bearing member with a charging device. The charging device can be appropriately selected according to the purpose. Examples thereof include publicly-known contact charging devices including an electro-conductive or semi-conductive roll, brush, film, or rubber blade, and contactless charging devices utilizing corona discharge such as a corotron and a scorotron.

Exposing can be performed by exposing the surface of the image bearing member to light with an exposing device. The exposing device can be appropriately selected according to the purpose. Examples thereof include exposing devices of various types such as of a copier optical system, a rod lens array system, a laser optical system, and a liquid crystal shutter optical system. A backlighting system of exposing the back surface of the image bearing member may also be employed.

The developing step is a step of forming a visible image by developing an electrostatic latent image with the toner of the present invention. The visible image can be formed by the developing unit. The developing unit may be appropriately selected from publicly-known designs. A preferable developing unit includes a developing device that houses the toner of the present invention and can supply the toner to an electrostatic latent image in a contacting manner or contactlessly. The developing device may be a single-color developing device or a multi-color developing device. Specific examples include a stirrer configured to charge a developer by friction-stirring the developer, and a developing device including a rotatable magnet roller.

In the developing device, the toner and the carrier are mixed and stirred, and the toner is electrically charged as a result of the mixing and stirring friction and retained on the surface of the rotating magnet roller in a chain-like formation to thereby form a magnetic brush. Because the magnet roller is located near the image bearing member, the toner constituting the magnet brush formed on the surface of the magnet roller is partially transferred to the surface of the image bearing member by an electric attractive force. As a result, the electrostatic latent image is developed by the toner, and a visible image made of the toner is formed on the surface of the image bearing member.

The transfer step is a step of transferring a visible image to a recording medium. It is preferable to use an intermediate transfer member, and to firstly transfer a visible image to the intermediate transfer member, and after this, secondly transfer the visible image to a recording medium. The toners used for this typically include 2 colors or more, and it is preferable to use full-color toners. Therefore, it is more preferable to include a first transfer step of transferring visible images to an intermediate transfer member to form a composite transfer image, and a second transfer step of transferring the composite transfer image to a recording medium.

Transfer can be performed by electrically charging the image bearing member with a transfer unit. The transfer unit preferably includes a first transfer unit configured to transfer visible images to an intermediate transfer member to form a composite transfer image, and a second transfer unit configured to transfer the composite transfer image to a recording medium. The intermediate transfer member may be appropriately selected from publicly-known transfer members according to the purpose. A transfer belt or the like may be used.

The transfer unit preferably includes a transfer device configured to electrically charge a visible image formed on the image bearing member so as to be separated to a recording medium. There may be one transfer unit or may be a plurality of transfer units. Specific examples of the transfer device include a corona transfer device utilizing a corona discharge, a transfer belt, a transfer roller, a pressure transfer roller, and an adhesive transfer device. A recording medium may be appropriately selected from publicly-known recording media, and a recording sheet may be used.

The fixing step is a step of fixing a visible image transferred to a recording medium thereon with the fixing unit. Fixing may be performed each time a toner of any color is transferred to a recording medium, or fixing may be performed simultaneously by overlaying the toners of the respective colors. The fixing unit may be appropriately selected according to the purpose. A publicly-known heating/pressurizing unit may be used. The examples of the heating/pressurizing unit include a combination of a heating roller and a pressurizing roller, and a combination of a heating roller, a pressurizing roller, and an endless belt. Typically, the heating/pressurizing unit heats to preferably 80° C. to 200° C. According to the purpose, a publicly-known optical fixing device may be used together with the fixing unit or instead of the fixing unit.

The charge eliminating step is a step of eliminating charges by applying a charge eliminating bias to the image bearing member, and can be performed by the charge eliminating unit. The charge eliminating unit may be appropriately selected from publicly-known charge eliminating devices. A charge eliminating lamp or the like can be used.

The cleaning step is a step of removing toner remained on the image bearing member, and can be performed by the cleaning unit. The cleaning unit may be appropriately selected from publicly-known cleaners. Examples thereof include a magnetic cleaner, an electrostatic cleaner, a magnetic roller cleaner, a blade cleaner, a brush cleaner, and a web cleaner. A blade cleaner is preferably used.

The recycling step is a step of recycling the toner removed in the cleaning step to the developing unit, and can be performed by the recycling unit. The recycling unit may be appropriately selected according to the purpose. A publicly-known conveying unit or the like can be used.

The controlling step is a step of controlling the respective steps, and can be performed by the control unit. The control unit may be appropriately selected according to the purpose. Devices such as a sequencer and a computer can be used.

A process cartridge of the present invention is used in the image forming apparatus of the present invention, supports the image bearing member and at least one unit selected from the charging unit, the developing unit, and the cleaning unit integrally, and is detachably mountable on the body of the image forming apparatus of the present invention.

Figure 3:
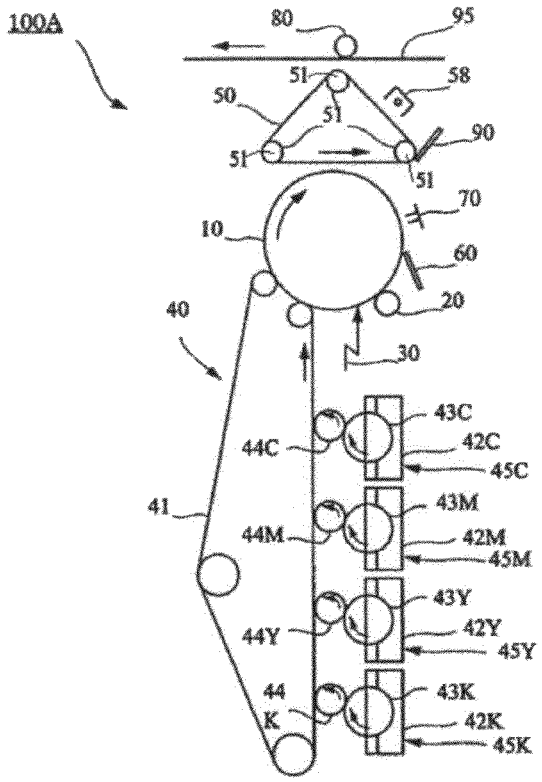
FIG. 3 is a schematic explanatory diagram showing an example image forming apparatus used in the present invention.

FIG. 3 shows an example image forming apparatus used in the present invention. An image forming apparatus 100A includes a drum-shaped photoconductor 10 as the image bearing member, a charging roller 20 as the charging unit, an exposing device 30 as the exposing unit, a developing device 40 as the developing unit, an intermediate transfer member 50, a cleaning device 60 as the cleaning unit, and a charge eliminating lamp 70 as the charge eliminating unit.

The intermediate transfer member 50 is an endless belt, and tensed over three rollers 51 so as to be able to move in the direction of the arrow. Some of the three rollers 51 also function(s) as a transfer bias roller capable of applying a predetermined transfer bias (a first transfer bias) to the intermediate transfer member 50. The cleaning device 90 including a cleaning blade is provided near the intermediate transfer member 50. A transfer roller 80 as a transfer unit capable of applying a transfer bias for transferring (secondly transferring) a visible image (a toner image) to a recording sheet 95 as the recording medium is provided oppositely to the intermediate transfer member. A corona charging device 58 configured to impart charges to a toner image on the intermediate transfer member 50 is provided on the periphery of the intermediate transfer member 50, at a portion between a region where the photoconductor 10 and the intermediate transfer member 50 contact each other and a region where the intermediate member 50 and the transfer sheet 95 contact each other, in the direction of rotation of the intermediate transfer member 50.

The developing device 40 is constituted by a developing belt 41 as a developer bearing member, and a black developing device 45K, a yellow developing device 45Y, a magenta developing device 45M, and a cyan developing device 45C arranged side by side on the circumference of the developing belt 41. The black developing device 45K includes a developer container 42K, a developer feeding roller 43K, and a developing roller 44K. The yellow developing device 45Y includes a developer container 42Y, a developer feeding roller 43Y, and a developing roller 44Y. The magenta developing device 45M includes a developer container 42M, a developer feeding roller 43M, and a developing roller 44M. The cyan developing device 45C includes a developer container 42C, a developer feeding roller 43C, and a developing roller 44C. The developing belt 41 is an endless belt, is tensed over a plurality of belt rollers so as to be able to move in the direction of the arrow, and partially contacts the photoconductor 10.

In the image forming apparatus 100A, the charging roller 20 electrically charges the photoconductor 10 uniformly, and after this, the exposing device 30 exposes the photoconductor 10 to light to thereby form an electrostatic latent image. Then, the developing device 40 feeds the developers to the electrostatic latent image formed on the photoconductor to develop the electrostatic latent image to thereby form a toner image. The toner image is transferred (firstly transferred) to the intermediate transfer member 50 by a voltage applied by the roller 51, and then further transferred (secondly transferred) to the recording sheet 95. As a result, a transfer image is formed on the recording sheet 95. Any toner remained on the photoconductor 10 is removed by the cleaning device 60 including the cleaning blade, and charges built up on the photoconductor 10 are eliminated by the charge eliminating lamp 70.

Figure 4:
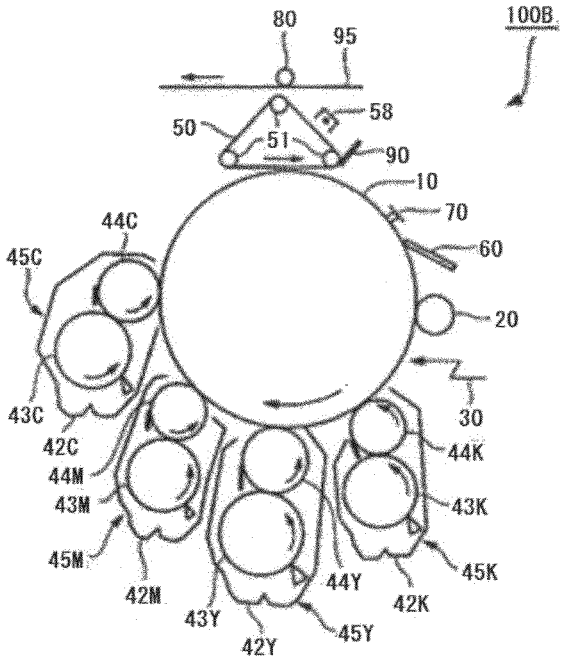
FIG. 4 is a schematic explanatory diagram showing another example image forming apparatus used in the present invention.

FIG. 4 shows another example image forming apparatus used in the present invention. An image forming apparatus 100B has the same configuration as the image forming apparatus 100A, except that it does not include a developing belt, and it has a black developing device 45K, a yellow developing device 45Y, a magenta developing device 45M, and a cyan developing device 45C arranged on the circumference of a photoconductor 10 so as to face the photoconductor 10, and has the same effects. In FIG. 4, those that are the same as shown in FIG. 3 are denoted with the same signs.

Figure 5:
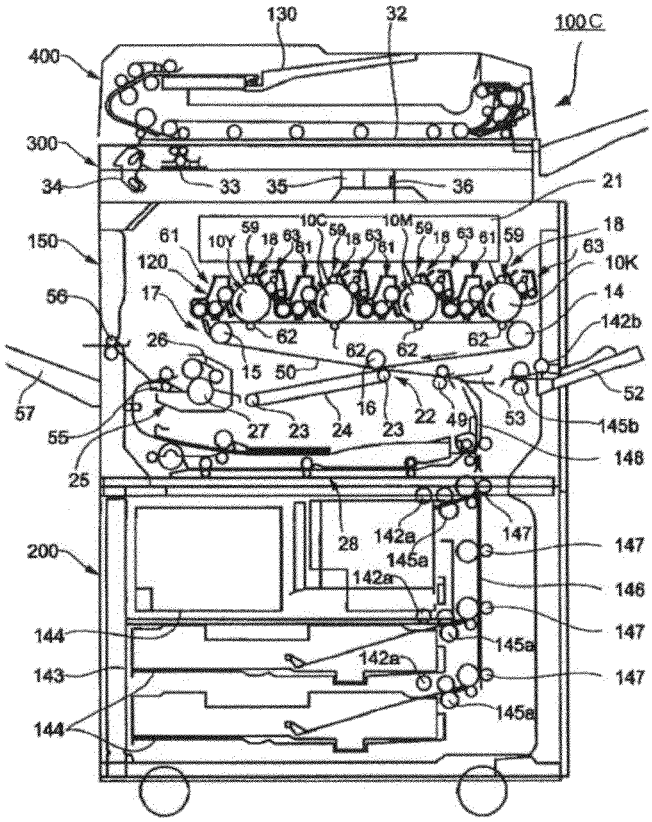
FIG. 5 is a schematic explanatory diagram showing another example image forming apparatus used in the present invention.

FIG. 5 shows another example image forming apparatus used in the present invention. An image forming apparatus 100C is a tandem color image forming apparatus. The image forming apparatus 100C includes a copier body 150, a sheet feeding table 200, a scanner 300, and an automatic document feeder 400. The copier body 150 includes an endless-belt-shaped intermediate transfer member 50 in the center thereof. The intermediate transfer member 50 is tensed over support rollers 14, 15, and 16 so as to be able to move clockwise. An intermediate transfer member cleaning device 17 configured to remove toner remained on the intermediate transfer member 50 is provided near the support roller 15. The intermediate transfer member 50 tensed by the support rollers 14 and 15 is provided with a tandem developing device 120 including image forming units 18 for four colors of yellow, cyan, magenta, and black, which are arranged side by side along the direction in which the intermediate transfer member 50 is conveyed, so as to face the intermediate transfer member. An exposing device 21 is provided near the tandem developing device 120. A second transfer device 22 is provided on a side of the intermediate transfer member 50 opposite to the side thereof on which the tandem developing device 120 is provided.

In the second transfer device 22, a second transfer belt 24, which is an endless belt, is tensed over a pair of rollers 23, and a recording sheet conveyed over the second transfer belt 24 and the intermediate transfer member 50 can contact each other. A fixing device 25 is provided near the second transfer device 22. The fixing device 25 includes a fixing belt 26, which is an endless belt, and a pressurizing roller 27 pressed against the fixing belt 26.

In the image forming apparatus 100C, a sheet overturning device 28 configured to overturn a transfer sheet is provided near the second transfer device 22 and the fixing device 25. This allows images to be formed on both sides of a recording sheet.

Next, full-color image formation (color copying) with the tandem developing device 120 will be explained. First, a document is set on a document table 130 of the automatic document feeder 400, or the automatic document feeder 400 is opened to set the document on a contact glass 32 of the scanner 300, and then the automatic document feeder 400 is closed.

Upon a depression of a start switch (unillustrated), the scanner 300 is started after the document has been conveyed to the contact glass 32 when the document has been set on the automatic document feeder 400, or immediately after the depression of the start switch when the document has been set on the contact glass 32, and a first traveling member 33 and a second traveling member 34 are started to run. At this time, reflection light of light emitted by the first traveling member 33 and reflected from the surface of the document is reflected on a mirror of the second traveling member 34 and received by a reading sensor 36 through an imaging lens 35. As a result, a color document (a color image) is read as image information of the respective colors of black, yellow, magenta, and cyan. The image information of each color is transmitted to the image forming unit 18 of the corresponding color in the tandem developing device 120, so that a toner image of each color may be formed.

A toner image on the black photoconductor 19K, a toner image on the yellow photoconductor 10Y, a toner image on the magenta photoconductor 10M, and a toner image on the cyan photoconductor 10C are transferred (firstly transferred) to the intermediate transfer member 50 sequentially. The toner images of the respective colors are overlaid on the intermediate transfer member 50 to thereby form a composite color image (a color transfer image).

Figure 6:
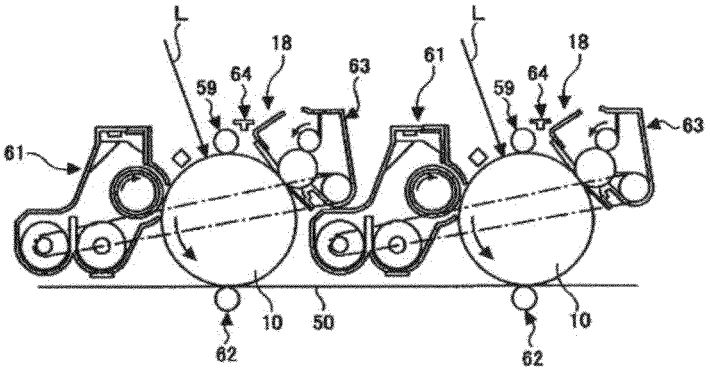
FIG. 6 a schematic explanatory diagram showing a portion of the image forming apparatus shown in FIG. 5.

As shown in FIG. 6, the image forming units 18 of the respective colors included in the tandem developing device 120 each include a photoconductor 10, a charging device 59 configured to electrically charge the photoconductor 10 uniformly, an exposing device 21 (unillustrated in FIG. 6) configured to form an electrostatic latent image on the photoconductor 10 by exposing the photoconductor 10 to light (indicated by L in the diagram) based on the image information of the corresponding color, a developing device 61 configured to form a toner image of the corresponding color on the photoconductor 10 by developing the electrostatic latent image with the toner of the corresponding color, a transfer charging device 62 configured to transfer the toner image of the corresponding color to the intermediate transfer member 50, a photoconductor cleaning device 63, and a charge eliminating device 64.

Returning to FIG. 5, in the sheet feeding table 200, one of sheet feeding rollers 142*a* is selectively rotated to bring forward recording sheets from one of sheet feeding cassettes 144 provided multi-stages in a paper bank 143. The sheets are sent forth to a sheet feeding path 146 one by one separately through a separating roller 145*a*, conveyed by a conveying roller 147 to be guided to a sheet feeding path 148 in the copier body 150, and stopped by being struck on a registration roller 49. Alternatively, a sheet feeding roller 142*b* is rotated to bring forward the recording sheets on a manual feeding tray 52, and the sheets are fed to a manual sheet feeding path 53 one by one separately through a separating roller 145*b*, and likewise stopped by being struck on the registration roller 49. The registration roller 49 is generally used in an earthed state, but may be used in a biased state in order to remove paper dusts of the sheets.

Then, the registration roller 49 is started to rotate so as to be in time for the color transfer image formed on the intermediate transfer member 50, and the recording sheet is sent forth to between the intermediate transfer member 50 and the second transfer device 22, so that a color transfer image may be formed on the recording sheet. Any toner remained on the intermediate transfer member 50 after transfer is cleaned away by the intermediate transfer member cleaning device 17.

The recording sheet on which the color transfer image is formed is conveyed by the second transfer device 22 to the fixing device 25, so that the color transfer image may be fixed on the recording sheet by heat and pressure. After this, the recording sheet is switched by a switching claw 55 to a discharging roller 56 to be discharged and stacked on a sheet discharging tray 57. Alternatively, the recording sheet is switched by the switching claw 55 to the sheet overturning device 28 to be overturned and guided again to the transfer position, and after having an image formed on the back surface thereof, discharged by the discharging roller 56 and stacked on the sheet discharging tray 57.

[Method for Measuring Characteristics of Toner]

<Weight Average Particle Diameter (Dw), Volume Average Particle Diameter (Dv), and Number Average Particle Diameter (Dn)>

The weight average particle diameter (Dw), the volume average particle diameter (Dv), and the number average particle diameter (Dn) of the toner are measured with a particle size meter ("MULTISIZER III" manufactured by Beckman Coulter Inc.) with an aperture diameter of 100 μm, and analyzed with an analyzing software program (BECKMAN COULTER MULTISIZER 3 VERSION 3.51). Specifically, a 10% by mass surfactant (alkyl benzene sulfonate NEOGEN SC-A manufactured by Dai-ichi Kogyo Seiyaku Co., Ltd.) (0.5 mL) is added to a 10 mL glass beaker. The toner (0.5 g) is added to the beaker and mixed with a micro spurtle, and then ion-exchanged water (80 mL) is added to the beaker. The obtained dispersion liquid is subjected to dispersion for 10 minutes with an ultrasonic disperser (W-113MK-II manufactured by Honda Electronics Co., Ltd.). The resulting dispersion liquid is measured with MULTISIZER III mentioned above, using ISOTON III (manufactured by Beckman Coulter Inc.) as a measurement solution. In the measurement, the toner sample dispersion liquid is dropped so that the concentration indicated by the instrument may become 8±2% by mass. In the present measurement, it is important to bring the concentration to 8±2% by mass, in terms of measurement reproducibility. As long as the concentration is within this range, the particle size will include no margin of error.

For example, the ratio (Dw/Dn) of the volume average particle diameter (Dw) of the toner produced by the producing method of the present invention to the number average particle diameter (Dn) thereof is preferably 1.20 or less, and more preferably from 1.00 to 1.20. When the ratio (Dw/Dn) of the weight average particle diameter to the number average particle diameter is less than 1.00, the toner, if contained in a two-component developer, will melt-adhere to the surface of the carrier as a result of being stirred in the developing device for a long term, which will reduce the charge ability of the carrier and degrade the cleaning performance, whereas the toner, if contained in a one-component developer, will film over the developing roller or melt-adhere to a member for thinning the toner to a thin layer such as a blade. When the ratio Dw/Dn is greater than 1.20, it may be harder to obtain a high-quality image with a high resolution, or the particle diameter of the toner may fluctuate greatly when the toner in the developer is consumed and supplied.

When the ratio (Dw/Dn) of the weight average particle diameter of the toner to the number average particle diameter thereof is from 1.00 to 1.20, the toner will be excellent in all of the storage stability, the low temperature fixability, and the hot offset resistance. Particularly, the toner will exhibit excellent image glossiness when used in a full-color copier. When used in a two-component developer, the toner in the developer will not have a great fluctuation in the particle diameter even after consumption and supply of the toner has been repeated for a long term, and will keep a preferable and stable developing ability even after it has been stirred for a long term in the developing device. When used in a one-component developer, the toner will not have a great fluctuation in the particle diameter even after consumption and supply of the toner has been repeated, will not film over the developing roller or melt-adhere to a member for thinning the toner to a thin layer such as a blade, and will keep a favorable and stable developing ability even after a long term of use (stirring) in the developing device, which makes it possible to obtain a high-quality image.

(One-Component Developer, Two-Component Developer)

When the toner of the present invention is used in a two-component developer, it may be used as mixed with a magnetic carrier. The content ratio between the carrier and the toner in the developer is preferably from 1 part by mass to 10 parts by mass of the toner to 100 parts by mass of the carrier. As the magnetic carrier, conventionally-known carriers such as iron powder, ferrite powder, magnetite powder, and magnetic resin carrier having a particle diameter of from 20 μm to 200 μm may be used. Examples of the coating material include amino-based resin such as urea-formaldehyde resin, melamine resin, benzoguanamine resin, urea resin, and polyamide resin.

As the coating material, polyvinyl resin, polyvinylidene resin, acrylic resin, polymethyl methacrylate resin, polyacrylonitrile resin, polyvinyl acetate resin, polyvinyl alcohol resin, polyvinyl butyral resin, polystyrene-based resin such as polystyrene resin and styrene-acrylic copolymer resin, halogenated olefin resin such as polyvinyl chloride, polyester-based resin such as polyethylene terephthalate resin and polybutylene terephthalate resin, polycarbonate-based resin, polyethylene resin, polyvinyl fluoride resin, polyvinylidene fluoride resin, polytrifluoroethylene resin, polyhexafluoropropylene resin, copolymer of vinylidene fluoride and acrylic monomer, copolymer of vinylidene fluoride and vinyl fluoride, fluoro-terpolymer such as terpolymer of tetrafluoroethylene, vinylidene fluoride, and nonfluorinated monomer, silicone resin, and epoxy resin can be used.

Electro-conductive powder or the like may be added to the coating resin according to the necessity. Examples of the electro-conductive powder include metal powder, carbon black, titanium oxide, tin oxide, and zinc oxide. These electro-conductive powders preferably have an average particle diameter of 1 μm or less. When the average particle diameter is greater than 1 μm, the electric resistance of the powder may be harder to control.

The toner of the present invention can also be used as a one-component magnetic toner or non-magnetic toner free from the carrier.

EXAMPLES

The toner and a producing method thereof according to the present invention will be described in more detail based on Examples and Comparative Examples. The present invention is not limited to Examples and Comparative Examples to be exemplified below. Values indicated with part represent part by mass, unless otherwise specified.

Example 1

Synthesis of Non-Crystalline Polyester (Low-Molecular Polyester) Resin

A 5 little four-necked flask equipped with a nitrogen introducing pipe, a dehydrating pipe, a stirrer, and a thermocouple was charged with bisphenol A-ethylene oxide 2 mol adduct (229 parts), bisphenol A-propylene oxide 3 mol adduct (529 parts), terephthalic acid (208 parts), adipic acid (46 parts), and dibutyltin oxide (2 parts), and they were reacted at normal pressures at 230° C. for 7 hours, and then further reacted at a reduced pressure of from 10 mmHg to 15 mmHg for 4 fours. After this, trimellitic anhydride (44 parts) was added to the reaction vessel, and the resultant was reacted at 180° C. at normal pressures for 2 hours, to thereby obtain [Non-Crystalline Polyester 1].

<Synthesis of Polyester Prepolymer>

A reaction vessel equipped with a cooling pipe, a stirrer, and a nitrogen introducing pipe was charged with bisphenol A-ethylene oxide 2 mol adduct (682 parts), bisphenol A-propylene oxide 2 mol adduct (81 parts), terephthalic acid (283 parts), trimellitic anhydride (22 parts), and dibutyltin oxide (2 parts), and they were reacted at normal pressures at 230° C. for 8 hours, and then further reacted at a reduced pressure of from 10 mmHg to 15 mmHg for 5 hours, to thereby obtain [Intermediate Polyester 1].

Next, a reaction vessel equipped with a cooling pipe, a stirrer, and a nitrogen introducing pipe was charged with [Intermediate Polyester 1] (410 parts), isophorone diisocyanate (89 parts), and ethyl acetate (500 parts), and they were reacted at 100° C. for 5 hours, to thereby obtain [Prepolymer 1].

<Synthesis of Ketimine>

A reaction vessel equipped with a stirring rod and a thermometer was charged with isophorone diamine (170 parts) and methyl ethyl ketone (75 parts), and reacted at 50° C. for 5 hours, to thereby obtain [Ketimine Compound 1].

<Synthesis of Master Batch (MB)>

Carbon black (PRINTEX35 manufactured by Degussa Inc.) [with a DBP oil absorption of 42 mL/100 mg, and pH=9.5] (540 parts), and polyester resin (1,200 parts) were added to water (1,200 parts), and they were mixed with a Henschel mixer (manufactured by Mitsui Mining Co. Ltd.), and the mixture was kneaded with two rolls at 150° C. for 30 minutes. The kneaded mixture was rolled, cooled, and pulverized with a pulverizer, to thereby obtain [Master Batch 1].

<Production of Oil Phase>

A vessel equipped with a stirring rod and a thermometer was charged with [Non-Crystalline Polyester 1] (378 parts), carnauba wax (110 parts), CCA (salicylic acid metal complex E-84, manufactured by Orient Chemical Industries, Ltd.) (22 parts), and ethyl acetate (947 parts), and they were warmed to 80° C. while being stirred, retained at 80° C. for 5 hours, and after this, cooled to 30° C. in 1 hour. Next, the vessel was charged with [Master Batch 1] (500 parts) and ethyl acetate (500 parts), and the resultant was mixed for 1 hour, to thereby obtain [Raw Material Dissolved Liquid 1].

[Raw Material Dissolved Liquid 1] (1,324 parts) was removed to another vessel, in order for the carbon black and wax to be subjected to dispersion with a beads mill (ULTRA VISCO MILL manufactured by IMEX Co., Ltd.) at a liquid sending speed of 1 kg/hr, a disk peripheral velocity of 6 m/second, with zirconia beads having a diameter of 0.5 mm packed to 80% by volume, for 3 passes. Next, a 65% by mass ethyl acetate solution of [Non-Crystalline Polyester 1] (1,042.3 parts) was added to the resultant, and subjected to the beads mill on the above conditions for 1 pass, to thereby obtain [Pigment/Wax Dispersion Liquid 1].

<Synthesis of Organic Particle Emulsion>

A reaction vessel equipped with a stirring rod and a thermometer was charged with water (683 parts), sodium salt of methacrylic acid ethylene oxide adduct sulfate (ELEMINOL RS-30 manufactured by Sanyo Chemical Industries, Ltd.) (11 parts), styrene (138 parts), methacrylic acid (138 parts), and ammonium persulfate (1 part), and they were stirred at 400 rpm for 15 minutes, which resulted in a white emulsion. The obtained while emulsion was heated until the internal temperature of the system reached 75° C., and then was reacted for 5 hours. A 1% by mass ammonium persulfate aqueous solution (30 parts) was added thereto, and the resultant was aged at 75° C. for 5 hours, to thereby obtain an aqueous dispersion liquid [Particle Dispersion Liquid 1] of a vinyl-based resin (copolymer of styrene-methacrylic acid-sodium salt of methacrylic acid ethylene oxide adduct sulfate).

<Preparation of Aqueous Phase>

Water (990 parts), [Particle Dispersion Liquid 1] (83 parts), a 48.5% by mass aqueous solution of sodium dodecyldiphenylether disulfonate (ELEMINOL MON-7 manufactured by Sanyo Chemical Industries, Ltd.) (37 parts), and ethyl acetate (90 parts) were mixed and stirred, to thereby obtain an opaque white liquid [Aqueous Phase 1].

<Emulsification/Desolventization>

[Pigment/Wax Dispersion Liquid 1] (664 parts), [Prepolymer 1] (109.4 parts), [Non-Crystalline Polyester 1] (73.9 parts), [Ketimine Compound 1] (4.6 parts) were put in a vessel, and mixed with a TK homomixer (manufactured by Primix Corporation) at 5,000 rpm for 1 minute. After this, [Aqueous Phase 1] (1,200 parts) was added to the vessel, and the resultant was mixed with the TK homomixer at 13,000 rpm for 20 minutes, to thereby obtain [Emulsion Slurry 1].

[Emulsion Slurry 1] was put in a vessel equipped with a stirrer and a thermometer, desolventized at 30° C. for 8 hours, and after this, aged at 45° C. for 4 hours, to thereby obtain [Dispersion Slurry 1].

<Washing/Drying>

[Dispersion Slurry 1] (100 parts) was subjected to filtration at reduced pressure. After this, (1): Ion-exchanged water (100 parts) was added to the filtration cake, and they were mixed with a TK homomixer (at 12,000 rpm for 10 minutes) and then subjected to filtration.

(2): A 10% by mass sodium hydroxide aqueous solution (100 parts) was added to the filtration cake obtained in (1), and they were mixed with the TK homomixer at 12,000 rpm for 30 minutes) and then subjected to filtration at a reduced pressure.

(3): A 10% by mass hydrochloric acid (100 parts) was added to the filtration cake obtained in (2), and they were mixed with the TK homomixer at 12,000 rpm for 10 minutes) and then subjected to filtration.

(4): Ion-exchanged water (100 parts) was added to the filtration cake obtained in (3), and they were mixed with the TK homomixer (at 12,000 rpm for 10 minutes) and then subjected to filtration. Mixing and filtration were performed twice, to thereby obtain [Filtration Cake 1].

[Filtration Cake 1] was dried with a circulating-air dryer at 45° C. for 48 hours, and sieved through a mesh having a mesh size of 75 μm, to thereby obtain [Toner Base Particles 1]. The particle diameter of the toner thusly obtained was 5.8 μm.

[Production of External Additives 1 to 13 (Coalesced Silicas 1 to 13)]

In the production of coalesced silicas 1 to 13, silica primary particles having various average particle diameters were used and secondarily aggregated with various treating agents, to thereby obtain coalesced silicas 1 to 13 shown in Table 1. The degree of coalescence was adjusted based on the average particle diameter of the silica primary particles used, the treating agents, the mixing ratio between the silica primary particles and the treating agent, and the treating conditions (burning temperature, burning time). The silica primary particles and the treating agent were mixed with the use of a spray dryer. The coalesced silicas produced in the present production example of coalesced silica are shown in Table 1.

TABLE 1

| | Silica production method | Silica shape | Degree of coalescence | Secondary particle diameter nm |
|---|---|---|---|---|
| Coalesced silica 1 | Sol-gel method | Aspherical | 3.2 | 160 |
| Coalesced silica 2 | Sol-gel method | Aspherical | 3.8 | 160 |
| Coalesced silica 3 | Sol-gel method | Aspherical | 3.2 | 75 |
| Coalesced silica 4 | Sol-gel method | Aspherical | 1.5 | 200 |
| Coalesced silica 5 | Sol-gel method | Aspherical | 4.2 | 220 |
| Coalesced silica 6 | Sol-gel method | Aspherical | 3.2 | 260 |
| Coalesced silica 7 | Sol-gel method | Aspherical | 2.5 | 220 |
| Coalesced silica 8 | Sol-gel method | Spherical | 1 | 90 |
| Coalesced silica 9 | Sol-gel method | Spherical | 1 | 260 |
| Coalesced silica 10 | Dry method | Aspherical | 3.2 | 160 |
| Coalesced silica 11 | Dry method | Aspherical | 3.2 | 300 |
| Coalesced silica 12 | Sol-gel method | Aspherical | 4 | 230 |
| Coalesced silica 13 | Sol-gel method | aspherical | 1.4 | 70 |

<External Addition Treatment>

The coalesced silica 1 shown in Table 1 (1.5 parts by mass), dry silica (H1303 (23 nm) manufactured by Clariant Japan K.K.) (1.0 part by mass), and titanium oxide having an average particle diameter of 20 nm (0.5 parts by mass), and the toner base particles 1 (100 parts by mass) were mixed with a Henschel mixer (manufactured by Mitsui Mining Co., Ltd.), and passed through a sieve with a mesh size of 400 mesh, to thereby obtain a toner 1.

Example 2

A toner 2 was obtained in the same manner as Example 1, except that the coalesced silica 1 used in the external addition treatment of Example 1 was changed to the coalesced silica 2 shown in Table 1.

Example 3

A toner 3 was obtained in the same manner as Example 1, except that the coalesced silica 1 used in the external addition treatment of Example 1 was changed to the coalesced silica 3 shown in Table 1.

Example 4

A toner 4 was obtained in the same manner as Example 1, except that the coalesced silica 1 used in the external addition treatment of Example 1 was changed to the coalesced silica 4 shown in Table 1.

Example 5

A toner 5 was obtained in the same manner as Example 1, except that the coalesced silica 1 used in the external addition treatment of Example 1 was changed to the coalesced silica 5 shown in Table 1.

Example 6

A toner 6 was obtained in the same manner as Example 1, except that the coalesced silica 1 used in the external addition treatment of Example 1 was changed to the coalesced silica 6 shown in Table 1.

Example 7

A toner 7 was obtained in the same manner as Example 1, except that the coalesced silica 1 used in the external addition treatment of Example 1 was changed to the coalesced silica 7 shown in Table 1.

Comparative Example 1

A toner 8 was obtained in the same manner as Example 1, except that the coalesced silica 1 used in the external addition treatment of Example 1 was changed to the coalesced silica 8 shown in Table 1.

Comparative Example 2

A toner 9 was obtained in the same manner as Example 1, except that the coalesced silica 1 used in the external addition treatment of Example 1 was changed to the coalesced silica 9 shown in Table 1.

Comparative Example 3

A toner 10 was obtained in the same manner as Example 1, except that the coalesced silica 1 used in the external addition treatment of Example 1 was changed to the coalesced silica 10 shown in Table 1.

Comparative Example 4

A toner 11 was obtained in the same manner as Example 1, except that the coalesced silica 1 used in the external addition treatment of Example 1 was changed to the coalesced silica 11 shown in Table 1.

Comparative Example 5

A toner 12 was obtained in the same manner as Example 1, except that the coalesced silica 1 used in the external addition treatment of Example 1 was changed to the coalesced silica 12 shown in Table 1.

Comparative Example 6

A toner 13 was obtained in the same manner as Example 1, except that the coalesced silica 1 used in the external addition treatment of Example 1 was changed to the coalesced silica 13 shown in Table 1.

[Points to be Evaluated]

(Percentage of Change in Specific Surface Area)

The percentage of change in the specific surface area of the toner when the toner is stored under high-temperature, high-humidity conditions was measured in the following manner.

The toner was stored at 40° C. at a relative humidity of 70% for 240 hours. The BET specific surface areas of the toner after stored and before stored were measured, and the percentage of change was calculated according to the following formula.

[(BET specific surface area of toner before storage−BET specific surface area of toner after high temperature high humidity storage)/BET specific surface area of toner before storage]×100(%)

(Image Quality)

A hundred and fifty thousand image charts as shown in FIG. 1 having image occupation rates of 100%, 75%, and 50%, 20%, 5%, and 0% were running-output. After this, a 2-dot image was output on sheets (6000 manufactured by Ricoh Company Ltd.), to recognize any fault images. The image quality was evaluated as A when there was no fault, and as B when there was a fault).

(Heat Resistant Storage Stability)

The toner was stored at 40° C. at a relative humidity of 70% for 2 weeks. After this, the toner was sieved with manual vibration, and the ratio of residual toner on the metal mesh was measured.

The heat resistant storage stability was evaluated as A when the residual ratio was 0% or greater but less than 1%, and as B when the residual ratio was 1% or greater.

(Low Temperature Fixability)

A non-fixed image was generated with a copier (IMAGIO NEO C355) manufactured by Ricoh Company Ltd. with an amount of deposition of a two-component developer of 4.0 g/m$^2$. Next, with an external fixing device that was remodeled from the fixing device (oil-less type) of the copier (IMAGIO NEO C355) manufactured by Ricoh Company Ltd. so as to be able to arbitrarily set the roller temperature, low temperature fixability was evaluated by fixing the sheet feeding speed to 120 mm/sec while varying the temperature. The fixing roller and the sheet were observed for any offset caused by insufficiently-melted toner, which would have had an image re-transferred to an image-free portion. The temperature at which no image was re-transferred was judged as an offset-free temperature on the low temperature side. A toner having an offset-free temperature of 120° C. or lower was evaluated as A, and a toner having an offset-free temperature of higher than 120° C. was evaluated as B.

(Charge Property)

An initial carrier (6.000 g) and an initial toner (0.452 g) were humidity-conditioned in a normal temperature normal humidity room (a temperature of 23.5° C. and a humidity of 60% RH) for 30 minutes or longer in an opened system, and then added to a stainless container, which was then hermetically sealed. The container was set in YS-LD [a shaker manufactured by YAYOI Co., Ltd.], which was set to a scale of 150 and driven for 1 minute to frictionally charge the sample about 1,100 times. The resulting sample was measured according to a common blow-off method [TB-200 manufactured by Toshiba Chemical Corporation]. Then, a carrier and a toner were humidity-conditioned under high-temperature, high-humidity conditions (a temperature of 35° C. and a humidity of 70% RH) for 24 hours in an opened system, and after this, humidity-conditioned in a normal temperature normal humidity room (a temperature of 23.5° C. and a humidity of 60% RH) for 30 minutes or longer in an opened system. The resulting sample was measured in the same manner. The charge property was evaluated as A when the amount of change between the measurement values was less than 5 (μc/g), and evaluated as B when it was 5 (μc/g) or greater.

(Filming Property)

The developing roller and the photoconductor that had outputted a thousand belt charts having image occupation rates of 100%, 75%, and 50% were observed for any filming, and evaluated based on the following criteria.

[Evaluation Criteria]

A: Filming not occurred

B: Filming occurred

The evaluation results are shown in Table 2.

(Total Judgment)

A total judgment was made. A toner that was graded A in all of the above evaluations was graded A as total judgment. A toner that was graded B in at least one of the above evaluations was graded B as total judgment.

TABLE 2

| | | | Percentage of change in toner specific surface area % | Image quality | filming | fixability | Storage property | Charge property | Total judgment |
|---|---|---|---|---|---|---|---|---|---|
| Ex. 1 | Toner 1 | Coalesced silica 1 | 34 | A | A | A | A | A | A |
| Ex. 2 | Toner 2 | Coalesced silica 2 | 27 | A | A | A | A | A | A |
| Ex. 3 | Toner 3 | Coalesced silica 3 | 45 | A | A | A | A | A | A |
| Ex. 4 | Toner 4 | Coalesced silica 4 | 43 | A | A | A | A | A | A |

TABLE 2-continued

| | | | Percentage of change in toner specific surface area % | Image quality | filming | fixability | Storage property | Charge property | Total judgment |
|---|---|---|---|---|---|---|---|---|---|
| Ex. 5 | Toner 5 | Coalesced silica 5 | 28 | A | A | A | A | A | A |
| Ex. 6 | Toner 6 | Coalesced silica 6 | 26 | A | A | A | A | A | A |
| Ex. 7 | Toner 7 | Coalesced silica 7 | 38 | A | A | A | A | A | A |
| Comp. Ex. 1 | Toner 8 | Coalesced silica 8 | 60 | B | A | A | B | B | B |
| Comp. Ex. 2 | Toner 9 | Coalesced silica 9 | 44 | B | B | B | B | B | B |
| Comp. Ex. 3 | Toner 10 | Coalesced silica 10 | 48 | B | A | A | B | B | B |
| Comp. Ex. 4 | Toner 11 | Coalesced silica 11 | 30 | B | B | A | B | B | B |
| Comp. Ex. 5 | Toner 12 | Coalesced silica 12 | 23 | B | A | B | A | A | B |
| Comp. Ex. 6 | Toner 13 | Coalesced silica 13 | 65 | B | B | B | B | B | B |

Aspects of the present invention are as follows, for example.

<1> An electrostatic charge image developing toner, including:

toner base particles including a polyester resin as a binder resin; and an external additive on a surface of the toner base particles, wherein the external additive includes silica, wherein the silica is produced by sol-gel method, and is aspherical, and wherein a percentage of change in specific surface area of the toner when it is stored under high-temperature, high-humidity conditions is from 25% to 45%.

<2> The electrostatic charge image developing toner according to <1>, wherein a secondary particle diameter of the silica is from 80 nm to 250 nm.

<3> The electrostatic charge image developing toner according to <1> or <2>, wherein a degree of coalescence of the silica is from 2.0 to 4.0.

<4> The electrostatic charge image developing toner according to any one of <1> to <3>, wherein a percentage of change in specific surface area of the toner when it is stored under high-temperature, high-humidity conditions is from 30% to 40%.

<5> The electrostatic charge image developing toner according to any one of <1> to <4>, wherein the polyester resin includes a non-crystalline polyester resin.

<6> The electrostatic charge image developing toner according to any one of <1> to <5>, wherein the toner base particles are obtained by dissolving or dispersing a binder resin, a binder resin precursor including a modified polyester-based resin, a colorant, and a releasing agent in an organic solvent to obtain an oil phase, dissolving a compound that is to undergo elongation, crosslinking, or both thereof with the binder resin precursor in the oil phase, dispersing the resulting oil phase in an aqueous medium in which a particle dispersant is present to obtain an emulsified dispersion liquid, allowing the binder resin precursor to undergo a crosslinking reaction, an elongation reaction, or both thereof in the emulsified dispersion liquid, and removing the organic solvent.

This application claims priority to Japanese application No. 2013-031754, filed on Feb. 21, 2013 and incorporated herein by reference.

What is claimed is:

1. An electrostatic charge image developing toner, comprising:

toner base particles that comprise a polyester resin as a binder resin; and an external additive on a surface of the toner base particles, wherein the external additive comprises silica modified with epoxy groups, wherein the silica is produced by sol-gel method, and is aspherical, and wherein a percentage of change in specific surface area of the toner when it is stored under high-temperature, high-humidity conditions is from 25% to 45%.

2. The electrostatic charge image developing toner according to claim 1, wherein a secondary particle diameter of the silica is from 80 nm to 250 nm.

3. The electrostatic charge image developing toner according to claim 1, wherein a degree of coalescence of the silica is from 2.0 to 4.0.

4. The electrostatic charge image developing toner according to claim 1, wherein a percentage of change in specific surface area of the toner when it is stored under high-temperature, high-humidity conditions is from 30% to 40%.

5. The electrostatic charge image developing toner according to claim 1, wherein the polyester resin comprises a non-crystalline polyester resin.

6. The electrostatic charge image developing toner according to claim 1, wherein the toner base particles are obtained by dissolving or dispersing a binder resin, a binder resin precursor that comprises a modified polyester-based resin, a colorant, and a releasing agent in an organic solvent to obtain an oil phase, dissolving a compound that is to undergo elongation, crosslinking, or both thereof with the binder resin precursor in the oil phase, dispersing the resulting oil phase in an aqueous medium in which a particle dispersant is present to obtain an emulsified dispersion liquid, allowing the binder resin precursor to undergo a crosslinking reaction, an elongation reaction, or both thereof in the emulsified dispersion liquid, and removing the organic solvent.

7. The electrostatic charge image developing toner according to claim 1, wherein a degree of coalescence of the silica is from 2.0 to 3.0.

8. The electrostatic charge image developing toner according to claim 1, wherein the silica modified with epoxy groups contains moieties represented by

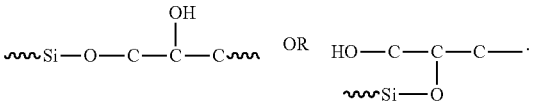

* * * * *